US007370859B2

(12) United States Patent
Asada

(10) Patent No.: US 7,370,859 B2
(45) Date of Patent: May 13, 2008

(54) SHEET FEEDER

(75) Inventor: Tetsuo Asada, Kuwana (JP)

(73) Assignee: Brother Koygo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 11/316,947

(22) Filed: Dec. 27, 2005

(65) Prior Publication Data

US 2006/0180992 A1 Aug. 17, 2006

(30) Foreign Application Priority Data

Dec. 27, 2004 (JP) ..... 2004-376507

(51) Int. Cl.
*B65H 3/52* (2006.01)

(52) U.S. Cl. ..... 271/121; 271/167

(58) Field of Classification Search ..... 271/121, 271/167

See application file for complete search history.

(56) References Cited

U.S. PATENT DOCUMENTS

| | | | | |
|---|---|---|---|---|
| 5,895,040 | A * | 4/1999 | Oleksa et al. | 271/124 |
| 6,279,897 | B1 | 8/2001 | Richards | |
| 7,066,461 | B2 * | 6/2006 | Asada | 271/121 |
| 2002/0070495 | A1 | 6/2002 | Takeuchi | |
| 2004/0084831 | A1 | 5/2004 | Asada | |
| 2005/0194734 | A1 * | 9/2005 | Asada et al. | 271/121 |
| 2006/0180992 | A1 * | 8/2006 | Asada | 271/121 |
| 2006/0180993 | A1 * | 8/2006 | Lee | 271/121 |

FOREIGN PATENT DOCUMENTS

| | | |
|---|---|---|
| EP | 1 125 873 A | 8/2001 |
| JP | 2002173240 | 6/2002 |

OTHER PUBLICATIONS

Extended European Search Report in Application No. EP 05 25 8050 dated Mar. 20, 2006.

* cited by examiner

*Primary Examiner*—David H Bollinger
(74) *Attorney, Agent, or Firm*—Banner & Witcoff, Ltd.

(57) ABSTRACT

Sheets are separated one-by-one from their stack placed in a holder by a sheet feed roller and a separation member provided in an inclined separation plate. The separation member can be a flat metal plate, and possibly includes a base portion, arm portions extending from the base portion, separation protrusions provided on the arm portions and capable of contacting a sheet, and elastic legs extending from the base portion. The arm portions, the separation protrusions, and the elastic legs can be arranged along a sheet feeding direction. The inclined separation plate may be provided with window holes on a central portion with respect to a direction perpendicular to the sheet feeding direction. The window holes can allow each separation protrusion or two or more separation protrusions to protrude toward the front surface of the inclined separation plate. Bridge portions can be provided between adjacent window holes. The bridge portions may strengthen the bending stiffness of the inclined separation plate in the direction perpendicular to the sheet feeding direction, and thus the separation protrusions are allowed to protrude only by a specified amount as designed.

24 Claims, 16 Drawing Sheets

SHEET FEEDER

CROSS REFERENCE TO RELATED APPLICATION

This application claims priority from Japanese Patent Application No. 2004-376507, filed on Dec. 27, 2004, the entire subject matter of which is incorporated herein by reference.

BACKGROUND

1. Technical Field

Aspects of the invention relate to a sheet feeder capable of separating sheets one-by-one from a stack of the sheets in a holder by a sheet feed roller and a separation member having elasticity.

2. Related Art

Image recording apparatuses such as a printer, a copier, a facsimile machine, generally include a sheet feeder that separates cut sheets (recording sheets) one-by-one and feeds them to an image recording unit.

In Japanese Laid-Open Patent Publication No. 2002-173240, cut sheets are accommodated substantially horizontally in an open-top box shaped cassette body, inclined separation face plates are provided at established intervals in a sheet width direction and on a downstream side of the cassette body with respect to a sheet feeding direction, and a sheet feed roller is provided in an upper portion of the cassette body and rotates while pressing a surface of an uppermost sheet of the stack. The sheets are separated one-by-one from the stack by the sheet feed roller in cooperation with the inclined separation faceplates, and fed via a U-turn path (a U-shaped conveying path) toward an image recording unit disposed in the upper portion of the cassette body.

Japanese Laid-Open Patent Publication No. 2004-149297 discloses a sheet feeder having an inclined wall designed to place a stack of sheets diagonally downward, a bottom plate provided in a lower portion of the inclined wall and having an obtuse angle with respect to the inclined wall and extending in a sheet width direction, and a sheet feed roller that feeds an uppermost sheet of a stack held between the bottom plate and the inclined wall by pressing against the sheet. The bottom plate is provided with a sheet separating portion made of a stainless steel. The sheet separating portion is comprised of protrusions that are arranged at established intervals in a sheet feeding direction, arm portions that support the protrusions at both sides, and a base portion that supports the arm portions continuously. The protrusions are set to protrude by a specific amount from long holes formed along the sheet feeding direction in a metal holder fixed to the bottom plate. When an uppermost sheet is pressed and fed by the sheet feed roller, the uppermost sheet presses the protrusions at its lower edge, the protrusions move down from the long holes of the holder due to the deformation of the arm portions by elasticity. However, sheets except for the uppermost sheet are held down by the protrusions protruding from the long holes and thus the uppermost sheet only is separated and fed.

However, in the structure disclosed in Japanese Laid-Open Patent Publication No. 2002-173240, a large gap exists between a position where the inclined separation face plate is provided and a position where the inclined separation face plate is not provided, and a sheet being fed is likely to be creased at its end portion. On the other hand, if the sheet separating portion formed of metal sheet disclosed in Japanese Laid-Open Patent Publication No. 2004-149297 is provided at the inclined separation face plates located on the downstream side of the cassette body disclosed in Japanese Laid-Open Patent Publication No. 2002-173240, the holder may be deformed due to a pressing force generated when the sheet is fed by the sheet feed roller, the protrusions may greatly protrude from the long holes in the holder, the sheet may be strongly rubbed by the protrusions and a surface of the sheet may be easily damaged.

Especially when glossy paper, suitable for photo image recording, is fed from a stack of a few glossy papers held in a deep cassette capable of holding a number of sheets toward a U-turn path having small radius of curvature, the glossy paper may be strongly rubbed by the protrusions because the paper is inherently hard to bend and returns to its flat state. As a result, a surface (recorded surface) of the glossy paper may be easily damaged. Furthermore, if the protrusions are shaped in the form of a claw, scratches on the surface of the sheet may appear and be deep.

SUMMARY

Aspects of the invention relate to a sheet feeder designed to feed a recording medium to an image reading unit and may prevent or reduce damage of the recording medium.

BRIEF DESCRIPTION OF THE DRAWINGS

Illustrative aspects of the invention will be described in detail with reference to the following figures wherein.

DETAILED DESCRIPTION

Figure 1:
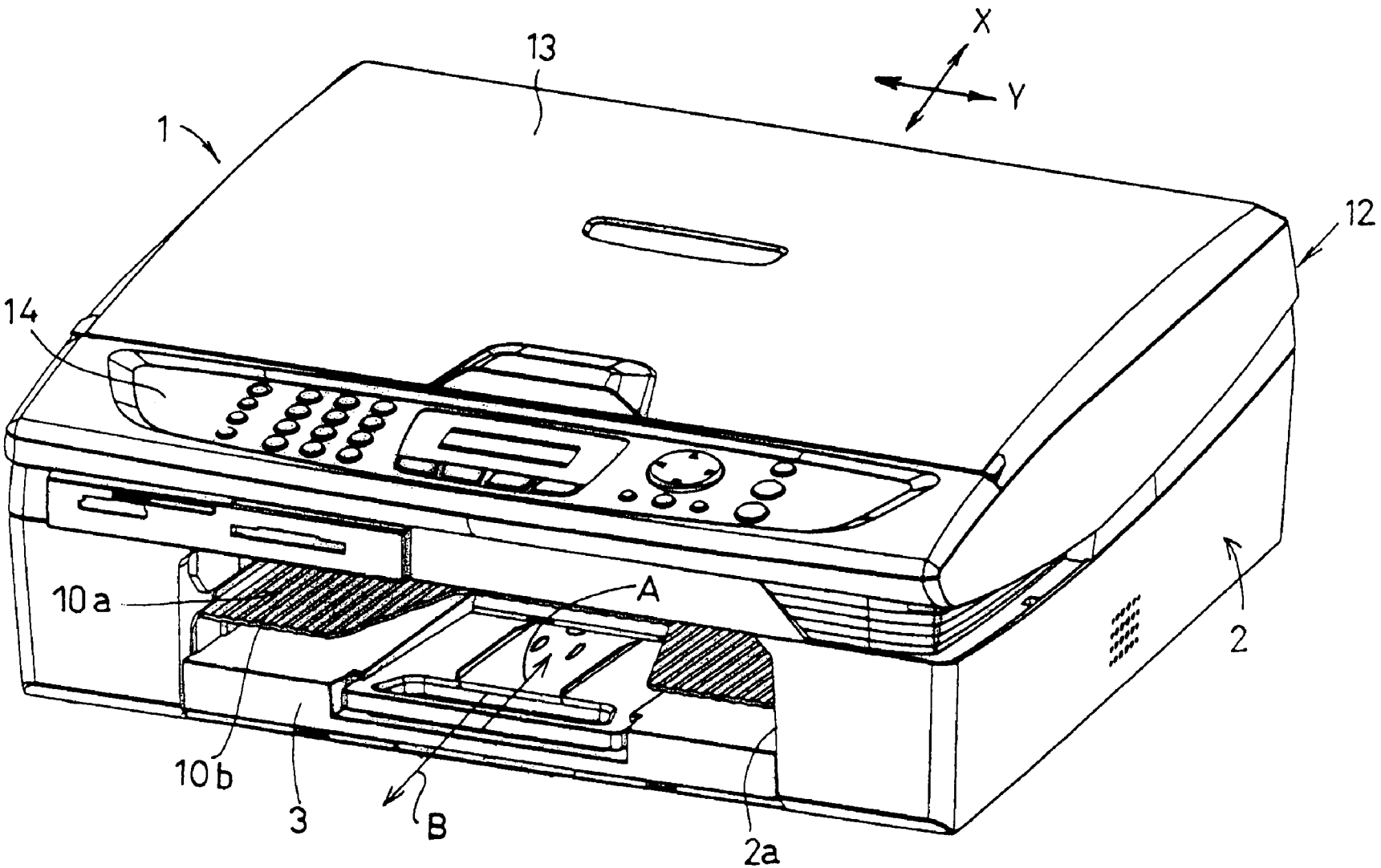
FIG. 1 is a perspective view of an image recording apparatus equipped with a sheet feeder according to an aspect of the invention.

It is noted that various connections are set forth between elements in the following description. It is noted that these connections in general and, unless specified otherwise, may be direct or indirect and that this specification is not intended to be limiting in this respect.

According to one aspect of the disclosure, a sheet feeder may include a cassette body capable of storing a number of recording sheets in a stack; a sheet feed roller capable of feeding an uppermost recording sheets in the stack; an inclined separation plate that is provided on a downstream side of the cassette body with respect to a sheet feeding direction, the inclined separation plate extending in a direction perpendicular to the sheet feeding direction; and a separation member that is attached to the inclined separation plate, the separation member capable of separating the recording sheets one-by-one from the stack in cooperation with the sheet feed roller. The separation member has a number of separation protrusions arranged along the sheet feeing direction, the inclined separation plate has a number of window holes arranged along the sheet feeding direction, and the separation protrusions protrude from the window holes in a direction where the inclined separation plate faces the recording sheets stored in the cassette body.

It is appreciated that the cassette and cassette body are optional as many devices may lack separate sheet cassettes. These systems may have fixed trays that allow for paper to be inserted from one or more directions. An example is a manual paper feed on the front of a printer. Systems lacking separate cassettes are not shown for simplicity, while noting that the invention may be applied to these systems as well. In general, cassettes, cassette bodies, and fixed trays and all other sheet holding structures are generally defined as "holders" for the purpose of this disclosure.

Bridge portions, which are provided between adjacent window holes, help to strengthen bending stiffness of the inclined separation plate, compared to a structure where a long narrow hole is provided to enclose the arm portions and the separation protrusions. As a result, in one illustrative example, the inclined separation plate does not have a sharp bend that protrudes toward the front side. The separation protrusions are allowed to protrude only by a specified amount as designed and each sheet P to be supplied can be reliably separated from the next. Thus, sheets feeding can be smoothly facilitated.

According to another aspect of the disclosure, the inclined separation plate is curved in the direction perpendicular to the sheet feeding direction so as to be directed back toward both end portions thereof.

With this structure, sheets to be fed can be easily separated from each other at the separation components.

According to a further aspect of the disclosure, the inclined separation plate has a uniform thickness in a portion provided between adjacent window holes and a neighboring portion thereof.

This structure improves bending stiffness at a central portion of the inclined separation plate with respect to its longitudinal direction According to a still further aspect of the disclosure, the number of window holes (two or more) is arranged in a center of the inclined separation plate with respect to the direction perpendicular to the sheet feeding direction.

With this structure, each sheet P to be supplied can be reliably separated from the next. Thus, sheets feeding can be smoothly facilitated.

According to an aspect of the disclosure, each of the number of separation protrusions (two or more) is capable of protruding from a corresponding one of the number of window holes.

Thus, each separation protrusion can protrude toward the front of the inclined separation plate by a specified amount.

According to an aspect of the disclosure, the separation member includes a number of arm portions each supporting a corresponding one of the number of separation protrusions, and each arm portion contacts an upstream-side end surface defining a corresponding one of window holes.

This structure can prevent deformation of the arm portions, which may occur as a result of bending toward the upstream side with respect to the sheet feeding direction, maintain the separation function, and reinforce the arm portions and the separation protrusions. In addition, this structure can prevent unnecessary deformation of the arm portions, which may occur when an end portion of a stack of a number of sheets stored in the cassette body contacts the separation protrusions.

According to an aspect of the disclosure, the separation member includes a number of arm portions each supporting a corresponding one of the number of separation protrusions, and each arm portion is located at a specified distance away from a downstream-side end surface defining a corresponding one of the window holes.

With this structure, when a sheet is separated from a stack of sheets and fed, the separation protrusions are allowed to bend toward the downstream side and thus the separation function can be maintained.

According to an aspect of the disclosure, a height of a separation protrusion located on a most downstream side with respect to the sheet feeding direction protruding from a corresponding window hole is less than a height of a separation protrusion located on an upstream side with respect to the sheet feeding direction protruding from a corresponding window hole.

With this structure, a leading or trailing end of the recording sheet contacts the tip of the separation components by a small amount. Damage on a recording sheet can be prevented even if the recording sheet is a glossy paper (or any other paper or material) that is inherently hard to bend.

According to an aspect of the disclosure, the sheet feeder may further include rollers provided on approximately a same downstream side as the separation protrusion located on the most downstream side, and on each side across the separation protrusion, wherein the rollers protrude from the inclined separation plate. In one example, a height of the rollers protruding from the inclined separation plate is substantially equal to or slightly less than a height of the separation protrusion located on the most downstream side with respect to the sheet feeding direction protruding from the corresponding window hole.

Thus, each roller can prevent the sheet P, which might be bent when it is fed by the sheet feed roller due to the applied feeding force, from being strongly pressed against the separation component located on the most downstream side at the front surface of the sheet. As a result, damage on the front surfaced of its sheet, like glossy paper, can be prevented, and thereby deterioration of image quality to be recorded can be prevented.

According to an aspect of the disclosure, the cassette body has an inclined separation plate supporting portion capable of detachably supporting the inclined separation plate.

Thus, the inclined separation plate can be attached to or removed from the cassette body as desired.

According to an aspect of the disclosure, the inclined separation plate may include an accommodating portion capable of accommodating the separation member therein, and the sheet feeder further comprises a supporting member capable of supporting the separation member in contact with the inclined separation plate in the accommodating portion.

Thus, each separation protrusion can protrude toward the front of the inclined separation plate by a specified amount.

Aspects of the invention will be described in detail with reference to the accompanying drawings.

Figure 2:
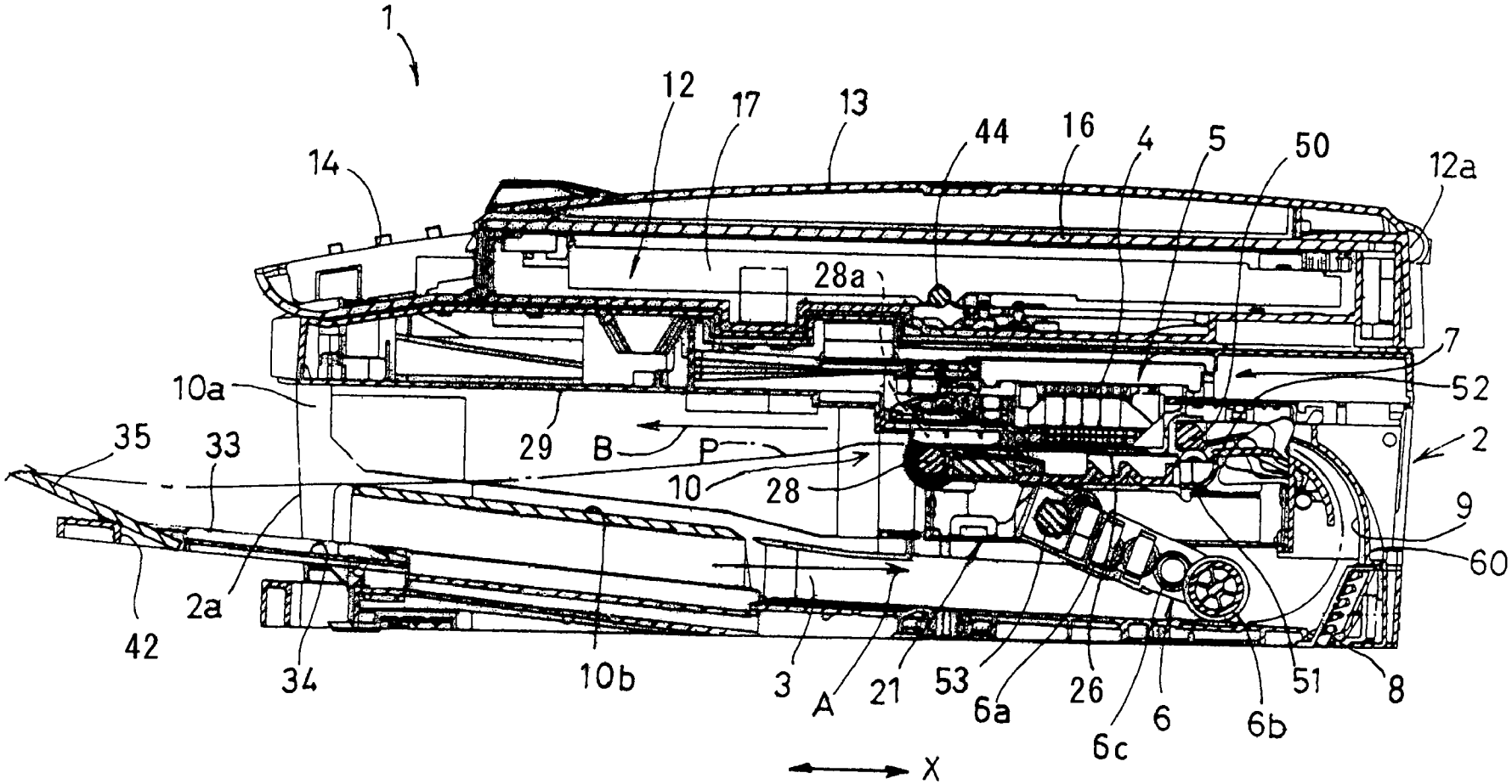
FIG. 2 is a sectional view of the image recording apparatus in accordance with aspects of the present invention.

An image recording apparatus 1 including a sheet feeder of the illustrative embodiment is a multifunction device (MFD) including printer, copier, scanner, and facsimile functions. As shown in FIGS. 1 and 2, the image recording apparatus 1 is provided with a housing 2 formed of synthetic resin by injection molding as a main body of the image recording apparatus.

It is appreciated that the sheet feeder may be used other devices that use sheet feeders including but not limited to facsimile machines, printers, copiers, and the like.

An image reading unit 12 used for copier and facsimile functions may be disposed in an upper portion of the housing 2. The image reading unit 12 may be designed to rotatably open at one side of the housing 2 via an axle portion (not shown). A document cover body 13 covering a top face of the image reading unit 12 may be attached to the image reading unit 12 at a rear end thereof so as to rotatably open at a rear end of the image reading unit 12 via a pivot shaft 12*a*.

An operation panel 14 may be provided at the front of the image reading unit 12 in the upper portion of the housing 2. The operation panel 14 includes various operation keys and may optionally include a liquid crystal display. On the top face of the image reading unit 12, a glass plate 16, where an original document to be scanned may be capable of being placed when the document cover body 13 may be opened upward, may be provided. Below the glass plate 16, a contact image sensor 17 may be provided so as to move along a guide shaft 44 extending in a direction perpendicular to a sheet of FIG. 2 (in a main scanning direction or Y-axis direction in FIG. 1).

In an ink storing portion (not shown), ink cartridges of black (Bk), cyan (C), magenta (M), and yellow (Y) are stored, for example. Each ink cartridge and a recording head 4 in a recording portion 7 (functioning as an image recording portion) are continuously connected via a flexible ink supply tube. Other combinations of ink or toner may be used as known in the art.

A cassette body 3 may be disposed at a lower portion (bottom) of the housing 2 and may be capable of inserting from an opening 2*a* at a front side (a left side of FIG. 2) of the housing 2. Sheets may be added to the cassette body 3 in at least one of the following ways: by at least partially removing cassette body 3 from housing 2, inserting sheets, and reinserting cassette body 3 into housing 2; and by directly adding sheets through an open end of cassette body 3. Alternatively, cassette body 3 may be fixed in housing 2 and not be removable. In this alternate example, sheets may be added through the end of cassette body 3.

In the illustrative embodiment, the cassette body 3 may be designed to be capable of holding a stack of sheets P with their short side extending in a perpendicular direction (the direction perpendicular to the sheet of FIG. 2, the main scanning direction, or the Y-axis direction) to a sheet feeding direction (a sub scanning direction or X-axis direction). The sheets P may be cut to any size such as A4 size, letter size, legal size, and postcard size, and the like.

The cassette body 3 may be provided with a bottom plate 31 where a sheet P may be to be placed, as shown in FIGS. 3, 4, 5, and 7. Side plates 32 stand on both sides of the bottom plate 31 on an upstream side thereof with respect to a sheet feeding direction (a direction of an arrow A). An output tray 10*b* may be detachably mounted over both side plates 32 to cover a part of the sheet P placed on the bottom plate 31 on the upstream side with respect to the sheet feeding direction (arrow A). A cutout portion 43, which may be shaped in substantially an angular U as viewed from the top, may be formed in a central portion of the output tray 10*b* at an end portion downstream in a sheet ejection direction (a direction of an arrow B). The cutout portion 43 facilitates supply of sheets P onto the bottom plate 31.

On a downstream side of the bottom plate 31 in the sheet feeding direction (arrow A), sheet width guides 45 are disposed movably to extend in a left-right direction (a direction of width of a sheet P). The sheet width guides 45 are configured to set the sheet P symmetrically with respect to a center of a width of the cassette body 3.

An auxiliary support member 33 of substantially a plate form may be disposed in a central portion of the bottom plate 31 with respect to its width on an end portion on an upstream side of the bottom plate 31 in the sheet feeding direction (arrow A). The auxiliary support member 33 may be slidable outward further from the end portion on the upstream side of the bottom plate 31 in the sheet feeding direction (arrow A). An auxiliary output tray 35 may be attached to the auxiliary support member 33. The auxiliary output tray 35 may be capable of supporting an end portion of the sheet P, projecting outward from the output tray 10*b*, on a downstream side in the sheet ejection direction (arrow B) (FIG. 2).

The auxiliary support member 33 includes a first storing portion 34 having an opening at its top face. The first storing portion 34 may be recessed near an end portion on an upstream side of the auxiliary support member 33 in the sheet feeding direction (arrow A). The auxiliary output tray 35 may be provided movably between a storage position where the auxiliary output tray 35 may be stored in the first storing portion 34 and an extension position (FIGS. 2, 3, and 5) where it extends in the sheet ejection direction further than the end portion on the upstream side of the bottom plate 31 in the sheet feeding direction (arrow A). The auxiliary output tray 35 may be capable of supporting the sheet P projecting outward in the extension position.

The auxiliary support member 33 includes a grasping opening 42 at an end portion on its upstream side further than the first storing portion 34 in the sheet feeding direction (arrow A). The grasping opening 42 may be provided through which an operator may insert his/her hand to grasp and slide out the auxiliary support member 33.

Figure 4:
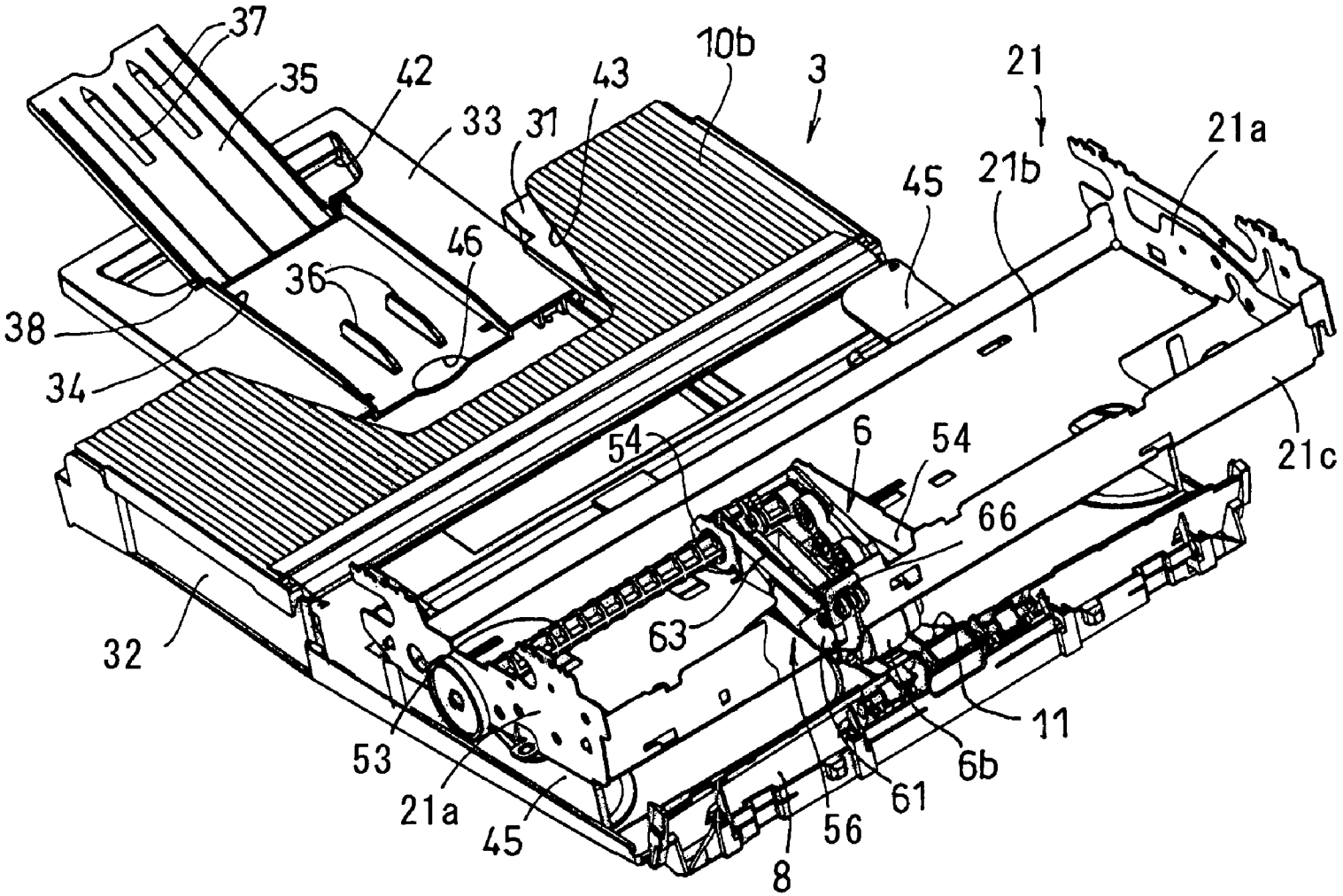
FIG. 4 is a perspective view showing the cassette body and a link mechanism in the main frame partially omitted in accordance with aspects of the present invention.

In the extension position, the auxiliary output tray 35 contacts an inner edge of the grasping opening 42 on the upstream side with respect to the sheet ejection direction (arrow B), and may be maintained on a slant so that its downstream side with respect to the sheet ejection direction (arrow B) may be higher than the upstream side (FIGS. 2 and 4). At this time, the end portion of the auxiliary output tray 35 on the downstream side with respect to the sheet ejection direction (arrow B) projects upward to a height where it may be substantially level with the output tray 10*b*. The slant of the auxiliary output tray 35 facilitates the receiving of the trailing end of its sheet P to be ejected from the output tray 10*b*. As the inner edge of the grasping opening 42 may be used for maintaining the slant of the auxiliary output tray 35, there may be no need to provide any additional special structure configured to maintain the slant. Alternatively, additional structure may be provided. The auxiliary support member 33 may be provided with a cutout portion 46 that facilitates grasping of the auxiliary output tray 35 at an end remote from a pivot 38 (FIG. 4) when the auxiliary output tray 35 is rotated.

The auxiliary output tray 35 includes a controlling portion that prevents the sheets P placed on the bottom plate 31 from bending downward at the first storing portion 34 when the auxiliary output tray 35 is in the extension position. The controlling portion may include first projecting strip portions 36 (FIGS. 3 and 4) that project upward from the bottom surface of the first storing portion 34 and extend in the sheet feeding direction (arrow A). The first projecting strip portions 36 also function as reinforcement ribs in the auxiliary support member 33 and improve stiffness of the auxiliary support member 33. Two first projecting strip portions 36 may be arranged side-by-side along a width of the first storing portion 34 on a downstream side of the bottom surface of the first storing portion 34 with respect to the sheet feeding direction (arrow A). The number of the first projecting strip portions 36 may be not limited to two, however, it may be preferable that the number of the first projecting strip portions 36 may be more than one to stably support the sheets P by preventing the bending.

The auxiliary output tray 35 may be formed with long holes 37 that are capable of engaging with the first projecting strip portions 36 when the auxiliary output tray 35 is in the storage position. When the auxiliary output tray 35 is stored in the first storing portion 34, upper ends of the first projecting strip portions 36 slightly project from the long holes 37. In other words, the auxiliary output tray 35 in a folded position may be placed within the height of the first projecting strip portions 36, and thus space to be taken up in a height direction can be made compact. In addition, as the first projecting strip portions 36 are provided on the downstream side of the bottom surface of the first storing portion 34 with respect to the sheet feeding direction (arrow A) as described above, the long holes 37 formed in the auxiliary output tray 35 can be spaced away from the pivot 38 that may be a central point on which the auxiliary output tray 35 is rotated. Thus, this prevents deterioration of the stiffness of the auxiliary output tray 35.

An inclined separation plate 8 having a separation member 11 may be detachably fixed on a rear side of the cassette body 3 (at the right side in FIG. 2). The separation member 11 may be configured to separate sheets P one-by-one at their leading edges. A sheet feeder 6 may be attached to the housing 2 so that an arm member 6*a* may be rotatable at its base end in the vertical direction. Rotation from a drive source (not shown) may be transmitted to a sheet feed roller 6*b* provided at a tip of the arm member 6*a* via a gear transmission mechanism 6*c* provided in the arm member 6*a* (FIG. 4). The sheet feed roller 6*b* and the separation member 11 in the inclined separation plate 8 cooperate with each other to separate an uppermost sheet P from a stack of sheets P placed in the cassette body 3 one-by-one and thus feed each sheet from the top of the stack. A sheet P separated from the stack may be conveyed, via a sheet conveying path 9 including a U-turn path, to the recording portion 7 that may be disposed above and behind the cassette body 3. The sheet conveying path 9 may be formed in a clearance between a first sheet conveying member 60 comprising an outer circumference of a U-turn shape and a second sheet conveying member 52 that may be a guide member comprising an inner circumference of the U-turn shape. The sheet conveying path 9 may be structured to feed a sheet P by aligning a centerline (not shown) of its sheet P with respect to a direction perpendicular to the sheet feeding direction (hereinafter referred to as just a "width direction") with a centerline (not shown) of the sheet conveying path 9 with respect to the width direction.

Figure 5:
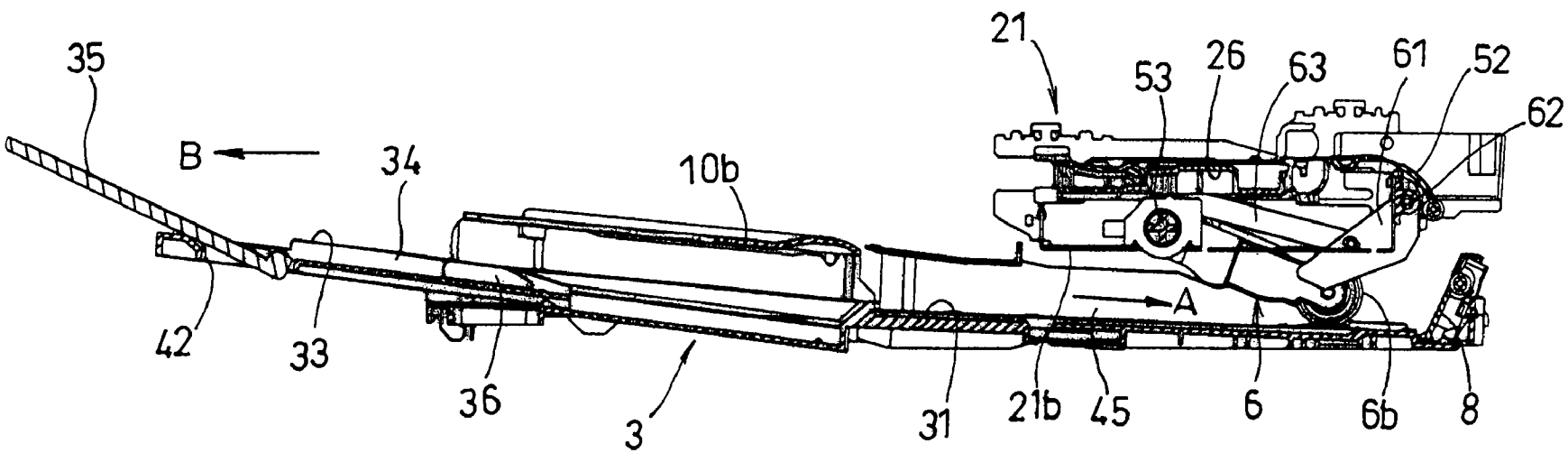
FIG. 5 is a sectional view taken along the arrowed line V-V of FIG. 3 in accordance with aspects of the present invention.

As shown in FIGS. 2, 4 and 5, the recording portion 7 may be supported by a box-shaped main frame 21 and side plates 21*a*, and formed between a first and second guide members (not shown) in the form of long plates extending in a main scanning direction (a Y-axis direction). A carriage 5 having an inkjet recording head 4 may be mounted on and slidably supported by the first guide member on an upstream side in the sheet feeding direction and the second guide member on a downstream side in the sheet feeding direction. Thus, the carriage 5 may be capable of reciprocating.

To reciprocate the carriage 5, a timing belt (not shown) extending in the main scanning direction may be disposed on a top surface of the second guide member disposed on the downstream side in the sheet feeding direction (arrow A). The timing belt may be driven by a carriage motor (not shown) that may be fixed at an underside of the second guide member.

Figure 3:
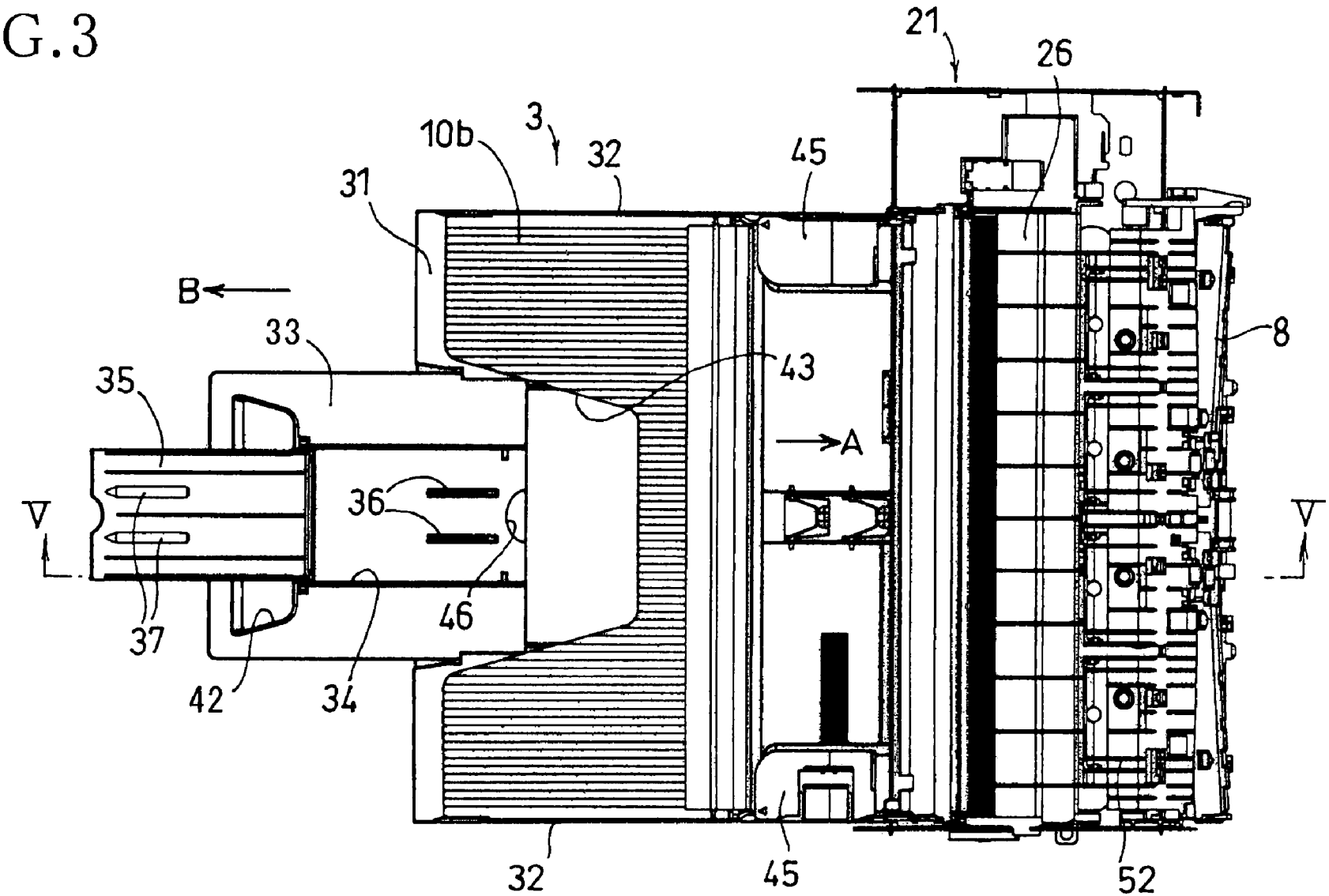
FIG. 3 is a plan view of a cassette body disposed in a lower portion of a main frame in accordance with aspects of the present invention.

A flat platen 26 extends in the Y-axis direction to face an underside of the recording head 4 of the carriage 5. The platen 26 may be fixed to the main frame 21 between the first and second guide members (FIGS. 3 and 5).

On an upstream side of the platen 26 in the sheet feed direction, a drive roller 50 and a driven roller 51, which faces the drive roller 50 from below, are disposed. The drive roller 50 and the driven roller 51 function as register rollers to convey a sheet P to the underside of the recording head 4. On a downstream side of the platen 26 in the sheet feed direction, an ejection roller 28 and a spur roller 28*a* are disposed (FIG. 2). The ejection roller 28 may be driven to convey (eject) a recorded sheet P to a sheet ejection portion 10. The spur roller 28*a* may be urged to the ejection roller 28.

The sheet ejection portion 10, where a sheet P recorded at the recording portion 7 is ejected with its recorded side face up, may be formed above the cassette body 3. An ejection opening 10*a* communicating with the sheet ejection portion 10 may be open toward the opening 2*a* at the front side of the housing 2. A partition plate (a lower cover member) 29, which may be made of a synthetic resin, covers the sheet ejection portion 10 from above in a range from the underside of the second guide member on the downstream side in the sheet feed direction to the ejection opening 10*a* (FIG. 2). The partition plate 29 may be formed integrally with the housing 2.

A structure of the sheet feeder 6 and a mechanism to move the sheet feeder 6 up and down in response to movement of the cassette body 3 will be described with reference to FIGS.

2, and 4 through 6. In the sheet feeder 6, the sheet feed roller 6*b*, wrapped with a material having high coefficient of friction such as rubber, may be rotatably supported at a free end portion (lower end) of the arm member 6*a* made of a synthetic resin and shaped in a frame. A drive shaft 53 made of the synthetic resin may be rotatably supported at the base end of the arm member 6*a*. Upon rotation of the drive shaft 53, the sheet feed roller 6*b* may be rotated in a fixed direction via the gear transmission mechanism 6*c* made up of a number of gears provided in the arm member 6*a*. The gear transmission mechanism 6*c* may be made up of a gear that rotates integrally with the drive shaft 53, a planetary gear that may be supported at an end of an arm engaged with the drive shaft 53 and meshed with the gear, and a number of immediate gears (three immediate gears in this illustrative embodiment) that transmit power from the planetary gear to a gear formed at a side of the sheet feed roller 6*b*.

The drive shaft 53, which may be driven by a drive motor (not shown), may be rotatably supported in holes (not shown) formed in a pair of shaft supporting plates 54 formed by lancing the side plate 21*a* and the bottom plate 21*b* in the main frame 21 shown in FIG. 4. The drive shaft 53 may be inserted into one end of the arm member 6*a* in the sheet feeder 6 so that a tip of the drive shaft 53 protrudes sideways. The other end of the arm member 6*a* may be disposed within an opening 55 formed in the base plate 21*b*. Thus, the arm member 6*a* and the drive shaft 53 are supported concentrically and rotatably with respect to the shaft holes in the pair of shaft support plates 54. The arm member 6*a* may be urged by an urging member (not shown, e.g. a torsion spring) so that the sheet feed roller 6*b* always faces downward.

Figure 6A:
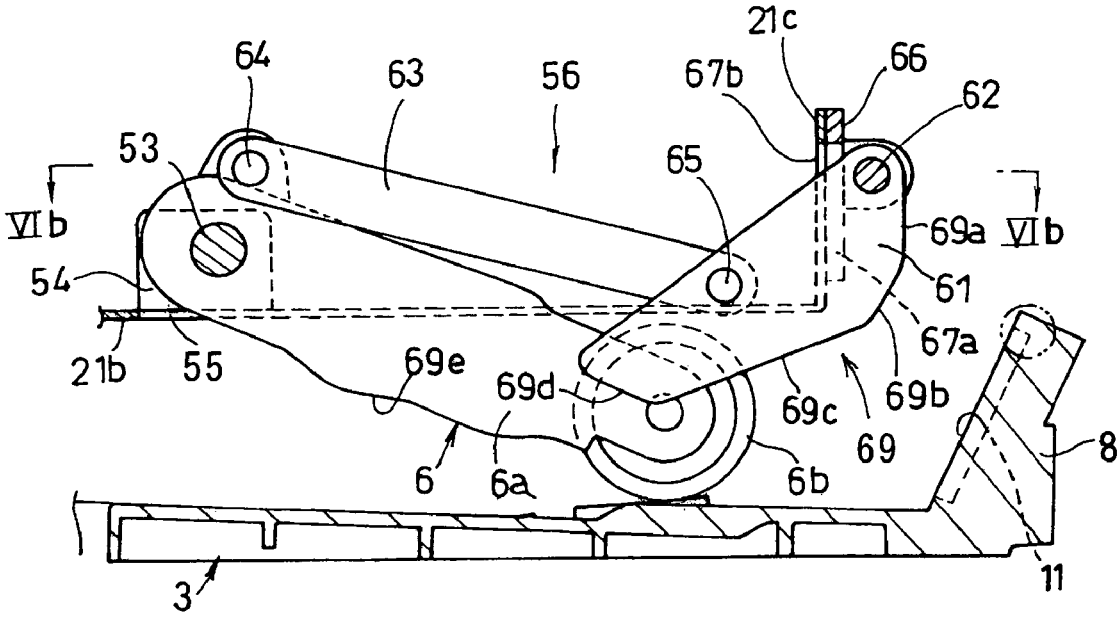
FIG. 6A is an enlarged sectional view of the link mechanism and the sheet feed roller in accordance with aspects of the present invention.
Figure 6B:
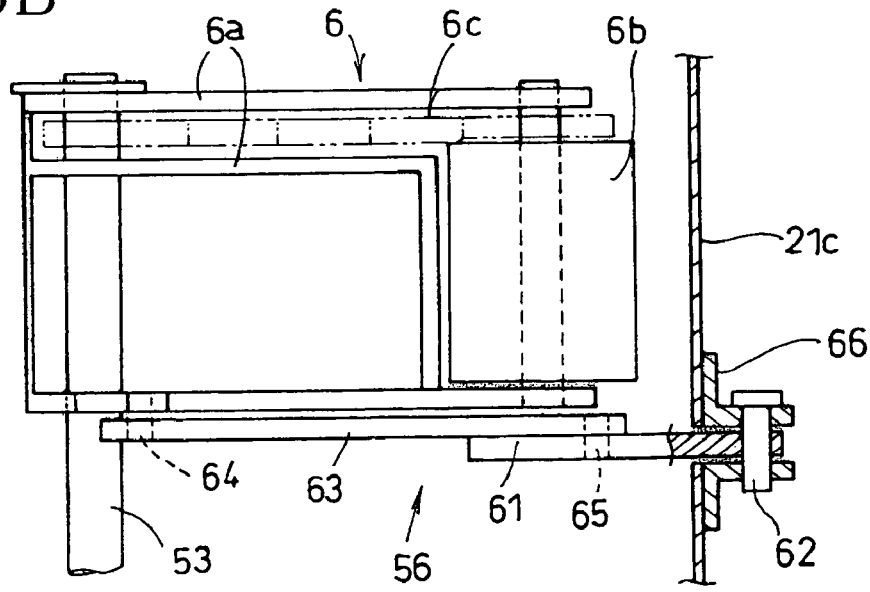
FIG. 6B is a sectional view taken along the arrowed line VIb-VIb of FIG. 6A in accordance with aspects of the present invention.

The following description will be made on a structure in which, when the cassette body 3 may be placed in or pulled out from the bottom of the housing 2, the arm member 6*a* and the sheet feed roller 6*b* automatically move up or down to separate from the upper end of the inclined separate plate 8, which may be a rear end wall of the cassette body 3. A link mechanism 56 may be configured to move the arm member 6*a* and the sheet feed direction 6*b* up and down. The link mechanism 56 includes a first link member 61 and a second link member 63 as shown in FIGS. 4, 5, 6A and 6B. The first link member 61 may be pivotally supported by a rear plate 21*c* standing at a rear side of the main frame 21 so as to vertically rotate on a first shaft 62. The second link member 63 may be rotatably connected, at one end, to an upper and rear portion of the arm member 6*a* via a second shaft 64 and, at the other end, to the first link member 61 via a third shaft 65. The second link member 63 may be arranged parallel to an outer surface of the arm member 6*a*, and the first link member 61 may be disposed parallel to an outer surface of the second link member 63. The first shaft 62 may be pivotally supported by a bracket 66 as shown in FIGS. 6A and 6B. The bracket 66 may be fixed to the rear plate 21*c* with a screw for example, and prevents weakening of solidity of the rear plate 21*c* due to formation of a guide groove 67*b*, which will be described later. The bracket 66 may be formed with a guide groove 67*a* that is open downward. When the bracket 66 is fixed to the rear plate 21*c*, the guide groove 67*a* of the bracket 66 overlaps with the guide groove 67*b* of the rear plate 21*c*, and a guiding portion of the first link member 61 moving vertically may be formed around the first shaft 62. The guide groove 67*b* of the rear plate 21*c* may be formed continuously with the bottom plate 21*b*.

A cam follower surface 69 may be formed on a lower surface of the first link member 61. When the cassette body 3 is placed in or pulled out, the first link member 61 slidingly contacts the upper end of the inclined separation plate 8 functioning as the rear end wall of the cassette body 3, and the sheet feed roller 6*b* and the arm member 6*a* can be retracted or moved up into an upper portion of the cassette body 3. Specifically, the cam follower surface 69 may be formed on the lower surface of the first link member 61, and may be curved to protrude in a downward direction. The cam follower surface 69 includes a first surface 69*a*, a second surface 69*b*, a third surface 69*c*, and a fourth surface 69*d*, which are continuously formed from a side close to the first shaft 62 toward a side close to the arm member 6*a*. A connecting portion between the second surface 69*b* and the third surface 69*c* protrudes the most. A fifth surface 69*e* may be formed on a lower surface of the arm member 6*a* (FIG. 6A).

The following description will be made on a movement where the arm member 6*a* and the sheet feed roller 6*b* retract or move up into the upper portion of the cassette 3 via the link 56 in response to insertion and removal of the cassette body 3. According to the above structure, the sheet feed roller 6*b* may be brought into contact with the uppermost sheet P of the stack of the sheets P in the cassette body 3 inserted in the housing 2 or the bottom plate 31 if there is no sheet P in the cassette body 3. In addition, the link mechanism 56 including the first link member 61 may be placed upstream from the inclined separation plate 8 of the cassette body 3 with respect to the sheet feeding direction. The following description will be made based on when no sheet P is placed in the cassette body 3. With this state, the third surface 69*c* and the fourth surface 69*d* of the first link member 61 are lowered to a position midway in a height of the sheet feed roller 6*b* at its side (FIG. 6A).

When the cassette body 3 is removed (pulled out) from the opening 2*a* of the housing 2, the first surface 69*a* or the second surface 69*b* of the cam follower 69 in the first link member 61 slidingly contacts the upper end of the inclined separation plate 8, and the first link member 61 may be pushed up and rotated on the first shaft 62 in a clockwise direction. As the second link member 63 may be rotatably connected to the first link member 61 via the third shaft 65, the second link member 63 may be rotated on the second shaft 64 in a counterclockwise direction, and the arm member 6*a* may be also rotated on the drive shaft 53 in the counterclockwise direction and upward. While the second surface 69*b* and the third surface 69*c* of the lower surface of the first link member 61 slidingly contact the upper end of the inclined separation plate 8 during drawing of the cassette body 3, the second link member 63 and the arm member 6*a* are rotated greatly upward to a higher position than the upper end of the inclined separation plate 8, so that they can be retracted or moved up higher than the upper end of the inclined separation plate 8.

In the above state, when the cassette body 3 is further drawn, the sheet feed roller 6*b* provided at the end of the arm member 6*a* moves over the upper end of the inclined separation plate 8, the cam follower 69 on the lower surface of the first link member 61 may be disengaged from the upper end of the inclined separation plate 8, and the fifth surface 69*e* on the lower surface of the arm member 6*a* slidingly contacts the upper end of the inclined separation plate 8. In this state, the sheet feed roller 6*b* and major part of the link mechanism 56 are stored in a space in an upper portion of the bottom plate 21*b* from the opening 55 (within the main frame 21). Thus, without the need to open up the space in a vertical direction between the bottom plate 21*b* and the cassette body 3, vertical rotation of the arm body 6*a* and the sheet feed roller 6*b* can be obtained. The upper end of the inclined separation plate 8 may be designed to set higher than the maximum stack height of sheets P that can be stored in the cassette body 3.

When the cassette body 3 is further pulled out, the upper end of the inclined separation plate 8 slidingly contacts the lower surface of the arm member 6*a* at the base portion (the drive shaft 53), and the arm body 6*a* and the major part of the link mechanism 56 are disconnected from the rear of the cassette body 3. When the arm member 6*a* completely climbs over the upper end of the inclined separation plate 8, the arm member 6*a* and the sheet feed roller 6*b,* which are urged downward, are moved down.

When the cassette body 3 is pushed (inserted) into the opening 2*a* of the housing 2, the mechanism works in the reverse order from the above: the arm body 6*a* may be pushed up at its lower surface by the upper end of the inclined separation plate 8; the upper end then slidingly contacts the fourth surface 69*d* of the first link member 61; and the sheet feed roller 6*b* may be retracted from the upper end of the inclined separation plate 8 and finally lowered toward the bottom plate 31 of the cassette body 3. When the sheets P in the stack are stored in the cassette body 3, the sheet feed roller 6*b* can contact the uppermost sheet P of the stack.

Figure 12:
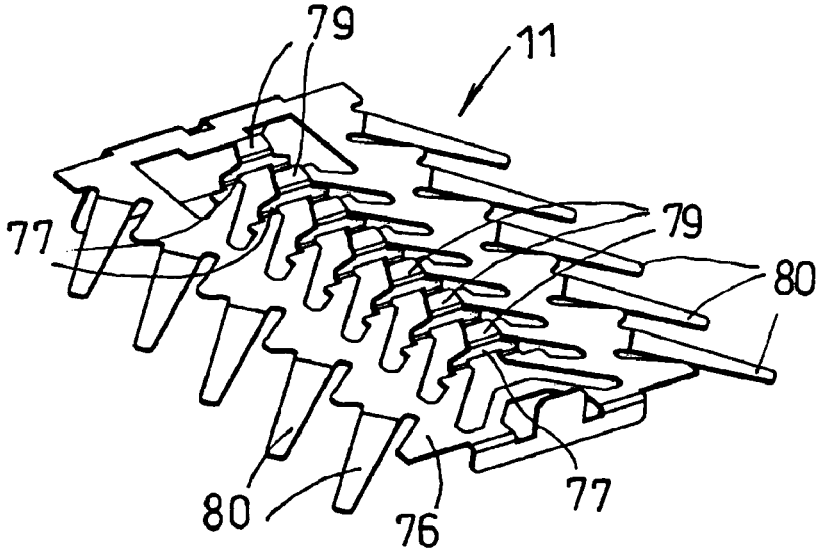
FIG. 12 is a perspective view of a separation member in accordance with aspects of the present invention.
Figure 13A:
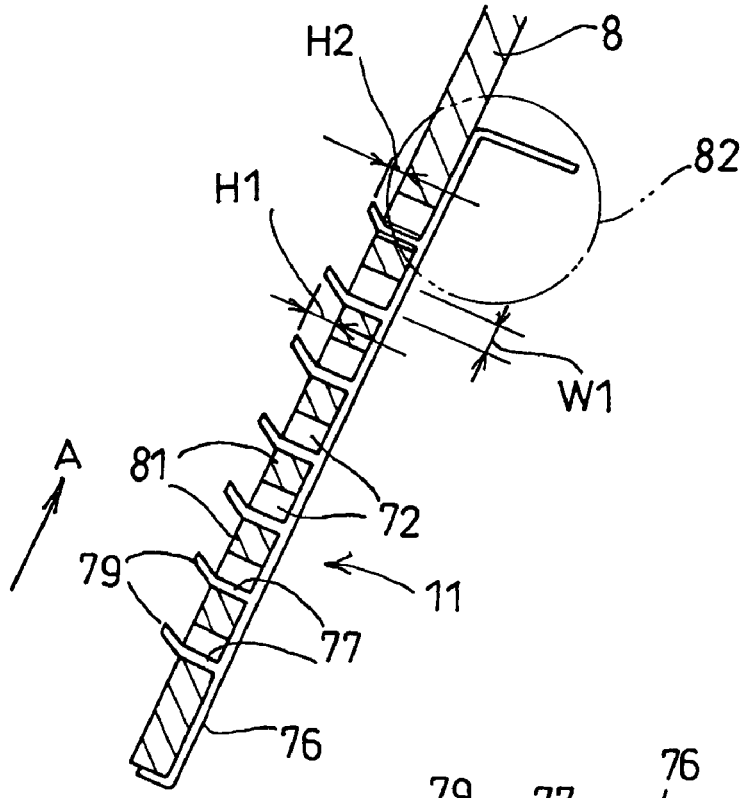
FIG. 13A is an enlarged sectional view taken along the arrowed line XIII-XIII of FIG. 11 in accordance with aspects of the present invention.
Figure 13B:
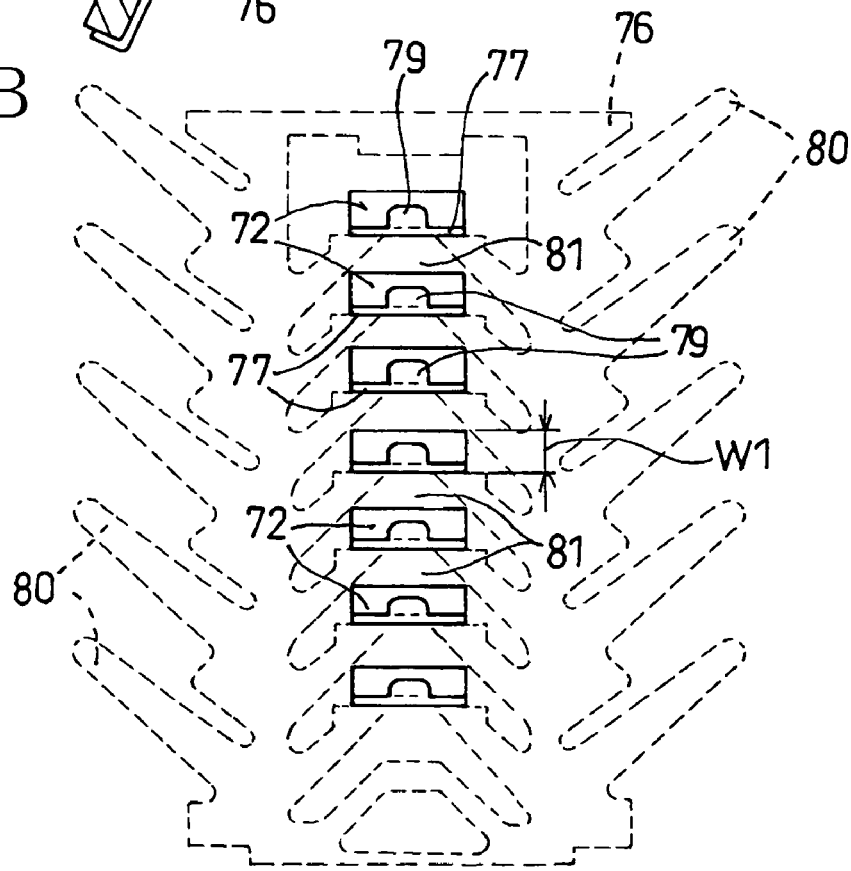
FIG. 13B is an enlarged sectional view taken along the arrowed line XIV-XIV of FIG. 11 in accordance with aspects of the present invention.

A structure of the separation member 11 and the inclined separation plate 8 will be described. As shown in FIGS. 12, 13A, and 13B, the separation member 11 may be of a flat shape and made of an elastic member (such as a thin metal used for a leaf spring). The separation member 11 includes a flat base portion 76, arm portions 77 formed in a row by lancing the base portion 76, and separation protrusions 79 provided at a tip (a free end) of each arm portion 77 and capable of tilting toward the downstream side in the sheet feeding direction. Elastic legs 80 protrude from both sides of the base portion 76 diagonally in a downward direction. The elastic legs 80 are configured to provide elastic force (urging force). With this structure, the separation member 11 can be easily manufactured by punching a metal sheet and then undergoing a specific bending process.

As shown in FIGS. 7 through 10, the inclined separation plate 8 for separating sheets may be disposed detachably to the rear end (the left end in FIG. 7) of the cassette body 3. The inclined separation plate 8 and the cassette body 3 are formed of synthetic resin by injection molding. The inclined separation plate 8 may be of a single continuous plate. The inclined separation plate 8 may be formed in a convex curve as viewed from the top to protrude at its central side with respect to the width of a sheet P (hereinafter refereed to as the sheet width direction, that is the Y-axis direction) so as to contact an end portion of its sheet P and to go back toward each side with respect to the sheet width direction. The separation member 11 may be configured to facilitate separation of sheets P in contact with their leading edges and may be attachable to the inclined separation plate 8 from the rear at the central portion of the inclined separation plate 8 with respect to the sheet width direction.

Figure 7:
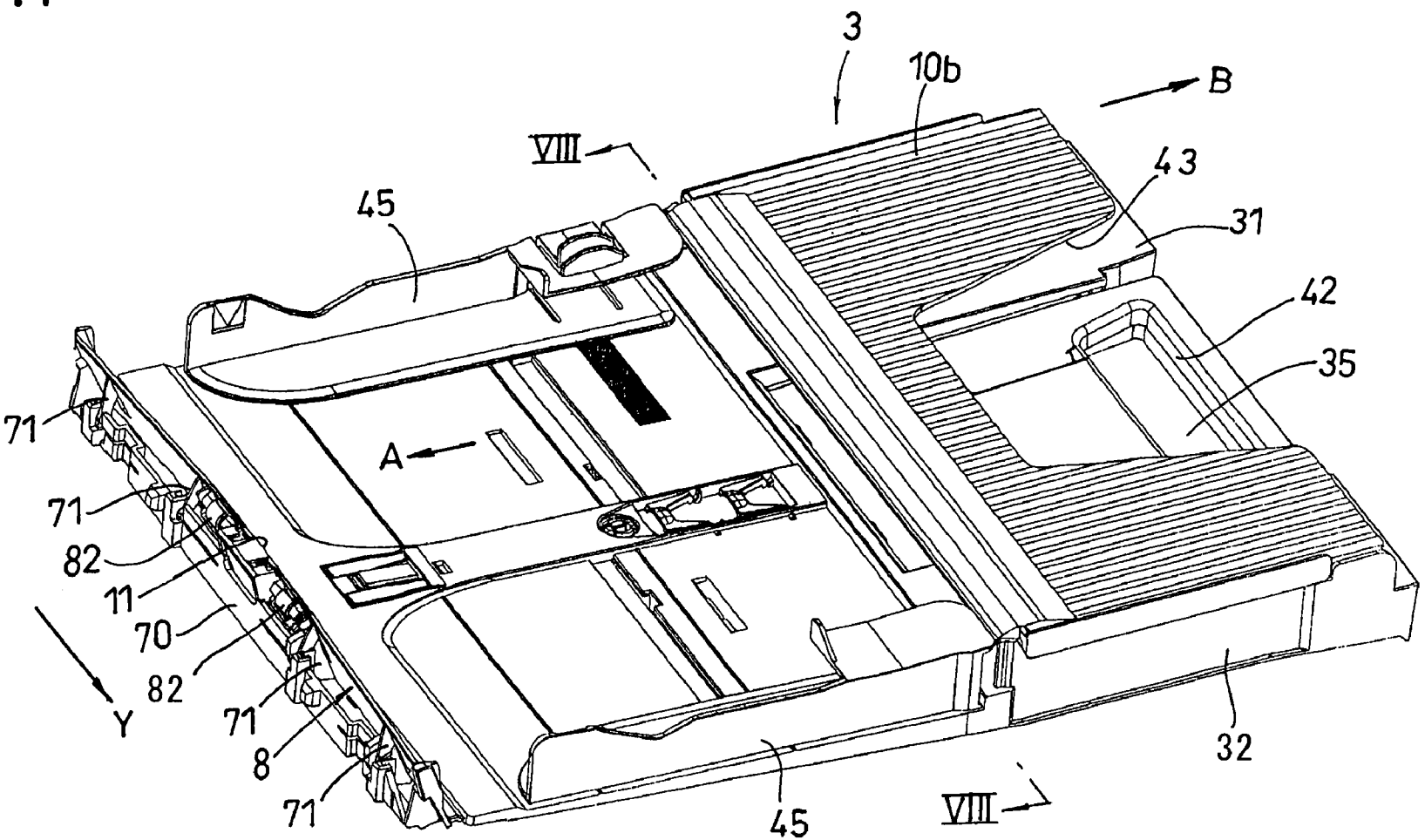
FIG. 7 is a perspective view of the cassette body in accordance with aspects of the present invention.

On a front side of a rear side plate 70 of the cassette body 3, a number of rear supporting portions 71 are spaced as appropriate along the Y-axis direction as shown in FIGS. 4 and 7. The rear supporting portions 71 are shaped in trapezoid (or triangle) in side view and configured to support the rear of the inclined separation plate 8 that may be a single continuous plate. Each rear supporting portion 71 has an engaged groove (not shown) extending downward from its upper end. Engaging claws 73 are formed integrally on the rear of the inclined separation plate 8. The engaging claws 73 are shaped like a letter T in cross section, and are capable of engaging with the engaged grooves of the rear supporting portions 71 from above. An envelope surface on the front side of the rear supporting portions 71 (opposite to the rear of the inclined separation plate 8) may be formed in a convex curve so as to protrude at a central portion with respect to the sheet width direction and go back toward each side (away from the leading end of the sheet P). Thus, by engaging each engaging claw 73 with its corresponding engaged groove, the inclined separation plate 8 may be supported from the rear at an inclined front surface of the rear supporting portions 71, and the inclined separation plate 8 may be formed in a curve so as to protrude at the central side with respect to the Y-axis direction.

Figure 8:
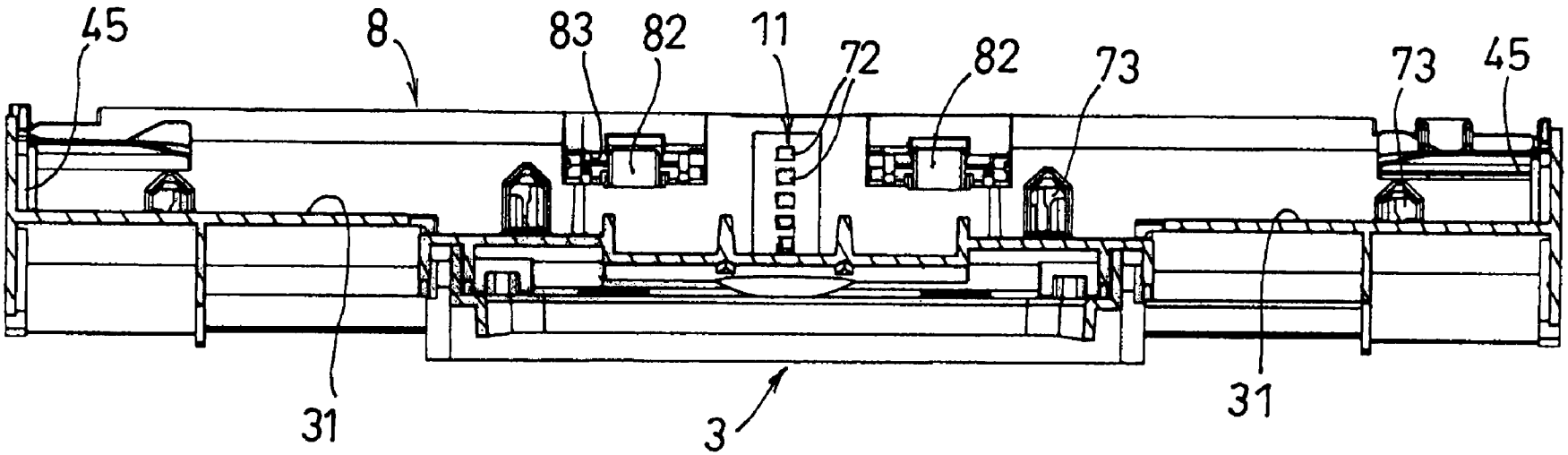
FIG. 8 is a sectional view taken along the arrowed line VIII-VIII of FIG. 7 in accordance with aspects of the present invention.
Figure 9:
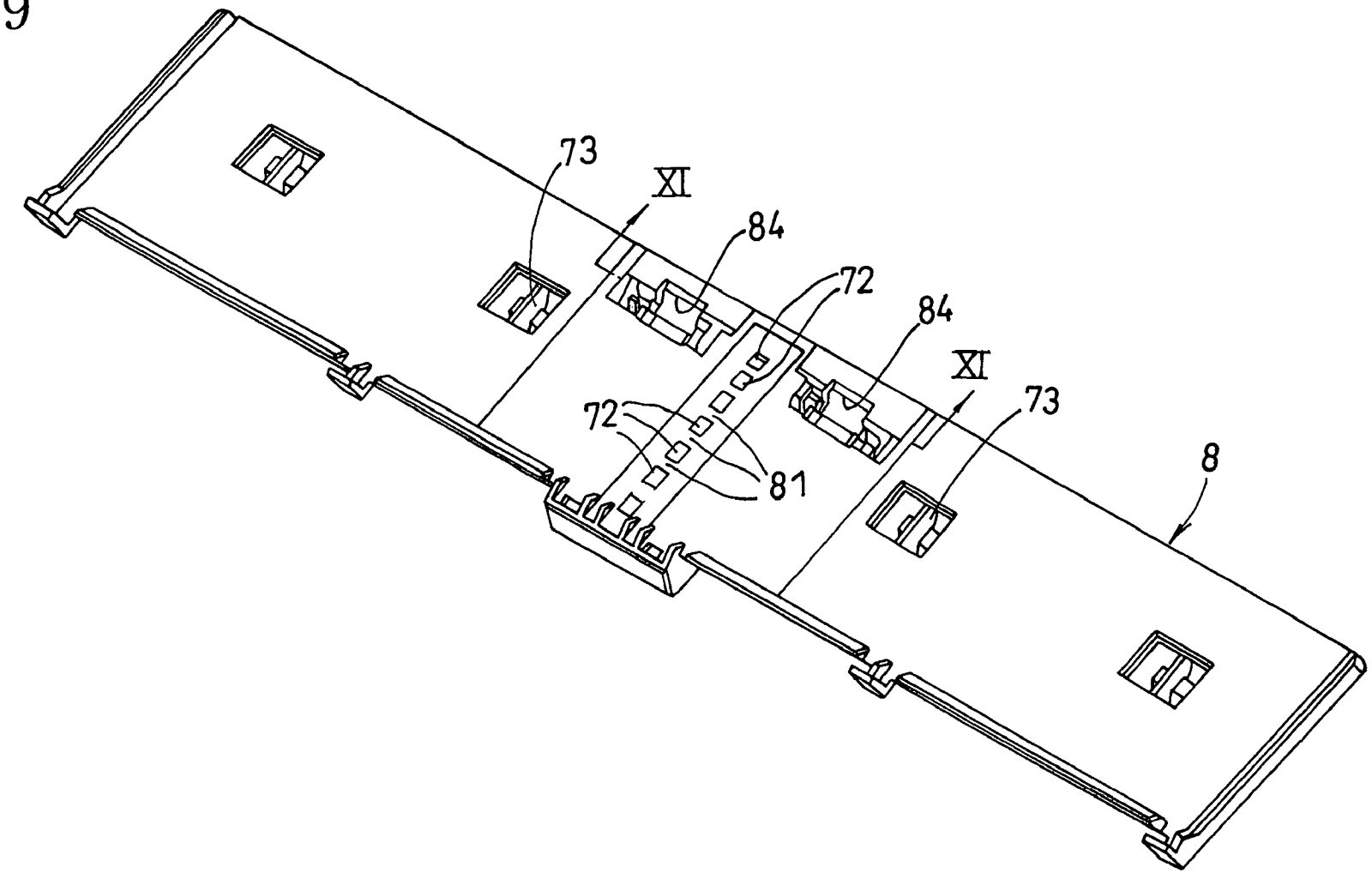
FIG. 9 is a perspective view of an inclined separation plate viewed from its front side in accordance with aspects of the present invention.
Figure 10:
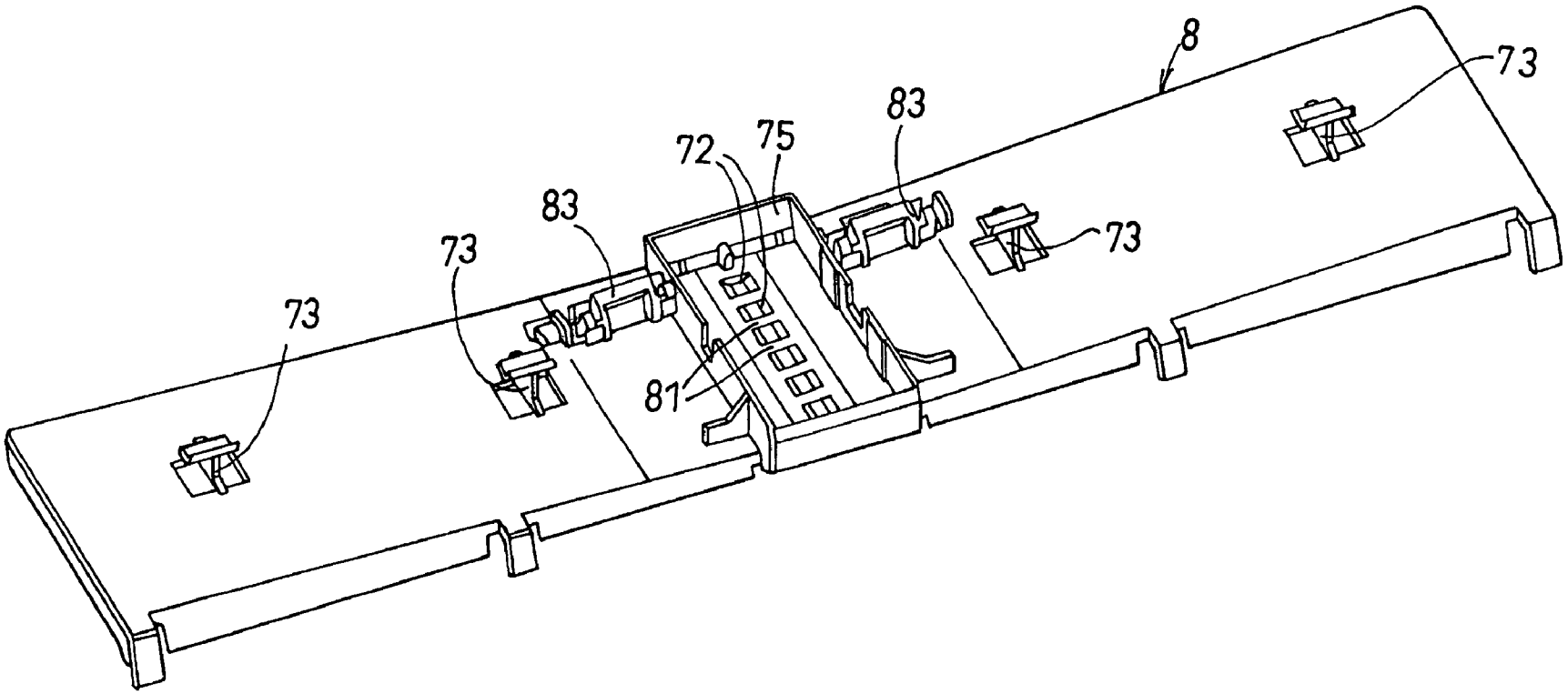
FIG. 10 is a perspective view of the inclined separation plate viewed from its back side in accordance with aspects of the present invention.

Window holes 72 are provided in the central portion of the inclined separation plate 8 with respect to its longitudinal direction (the Y-axis or the sheet width direction). The window holes 72 are opened to face the arm portions 77 and the separation protrusions 79 on the separation member 11 from the rear, and arranged in a row and at established intervals (equal to those of the arm portions 77 and the separation protrusions 79) along the sheet feeding direction (FIGS. 8, 9, and 10).

Figure 11:
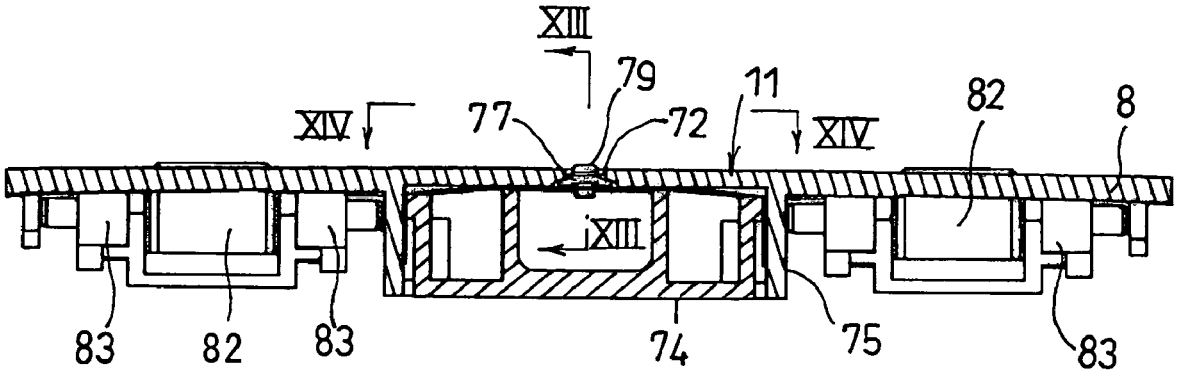
FIG. 11 is a sectional view taken along the arrowed line XI-XI of FIG. 9 in accordance with aspects of the present invention.

Thus, bridge portions 81, which are provided between adjacent window holes 72, are formed integrally with the inclined separation plate 8. The bridge portions 81 and their neighboring portions have a uniform thickness. On the rear of the inclined separation plate 8, a mounting case 75 may be also integrally formed to enclose all window holes 72 (FIGS. 10 and 11). The mounting case 75 may be configured to accommodate a box-shaped supporting member 74 made of a synthetic resin, which functions as a support member to support the separation member 11.

On the rear of the inclined separation plate 8, bearing portions 83 for a pair of rollers 82, which are rotatable to facilitate supplying of sheets P, are provided outside on both sides of the mounting case 57 with respect to the sheet width direction. Holes 84 are formed through the inclined separation plate 8 so as to view a circumferential surface of each roller 82 (FIGS. 9 through 11).

In the above structure, the separation member 11 may be inserted into the mounting case 75 from the rear of the inclined separation plate 8, each arm portion 77 may be engaged with a corresponding window hole 72, and then the supporting member 74 may be fixed, so that all elastic legs 80 of the separation member 11 are supported by the supporting member 74. As a result, the base portion 76 completely contacts the rear of the inclined separation plate 8, and each separation protrusion 79 protrudes toward the front of the inclined separation plate 8 by a specified amount (FIGS. 11 and 13A).

Then, each engaging claw 73 of the inclined separation plate 8 may be engaged, from above, with a corresponding engaged groove of its rear supporting portion 71 of the rear plate 10 of the cassette body 3, and the rear of the inclined separation plate 8 may be brought into contact with the inclined surface of each rear supporting portion 71. Thus, the inclined separation plate 8 may be also formed in a convex curve (in a bow) as viewed from the top so as to protrude at its central portion with respect to its longitudinal direction (the Y-axis direction or the sheet width direction) and go back toward each side (in a direction away from the leading end of a sheet P). In such a case, the inclined separation plate 8 may be supposed to have the greatest bending stress and deformation at its central portion with respect to its longitudinal direction (where the window holes 72 are provided). However, the bridge portions 81, which are provided between adjacent tiny window holes 72, help to strengthen (improve) bending stiffness at the central portion of the inclined separation plate 8 with respect to its longitudinal direction, compared to a structure where a long narrow hole may be provided to enclose the arm portions 77 and the separation protrusions 79. As a result, the inclined separation plate 8 does not have a sharp bend that protrudes toward the front side at its central portion (that is, the bridge portions 81 corresponding to the window holes 72). Thus, the separation protrusions 79 are allowed to protrude only by a specified amount as designed and each sheet P to be supplied can be reliably separated from the next.

In the separation member 11, an area of the base portion 76 adjacent to the arm portions 77 located on the most upstream and downstream sides with respect to the sheet feeding direction may be large, and stiffness of the base portion 76 may be higher at the most upstream and downstream sides than at an area of the base portion 76 adjacent to the arm portions 77 located in between. Thus, deformation of the separation protrusion 79 located on the most upstream side will be decreased. For this reason, when a sheet such as a glossy paper, which is hard to bend and returns to its original state (flat state) is fed, it may be strongly rubbed by the separation protrusion 79 located on the most upstream side and a front (recorded) surface of the sheet may be easily damaged at the leading or trailing end portion. If a sheet is fed from a deep cassette body holding a small stack of sheets or fed in the sheet conveying path 9 having a small radius of curvature of the U-turn, the sheet may be more easily damaged.

In this illustrative embodiment, the separation protrusions 79 are set so that a protrusion height H2 of the separation protrusion 79 located on the most downstream side with respect to the sheet feeding direction may be less than a protrusion height H1 of the separation protrusion 79 located on the upstream side (FIG. 13A). With this setting, even if a sheet P is a glossy paper that is hard to bend, an amount of the sheet P that contacts the tip of the separation protrusion 79 located on the most downstream side at its leading or trailing end is small, and the front surface of the sheet P may be prevented from being damaged.

The arm portion 77 and the separation protrusion 79 located on the most downstream side may be designed to have lower stiffness (elasticity) than the rest of the arm portions 77 and the separation protrusions 79 located on the upstream side. The arm portion 77 and the separation protrusion 79 located on the most downstream side may be reduced in size smaller or thinner than the arm portions 77 located on the upstream side. Thus, this structure can prevent damage on the front surface of its sheet P.

Each roller 82 may be located on approximately the same downstream side as the separation protrusion 79 located on the most downstream side, and on each side across the separation protrusion 79. A height of each roller 82 protruding from the inclined separation plate 8 may be substantially equal to or slightly less than the protrusion height H2 of the separation protrusion 79 located on the most downstream side with respect to the sheet feeding direction (FIG. 13A). Thus, each roller 82 can prevent the sheet P, which might be bent when it is fed by the sheet feed roller 6*b* due to the applied feeding force, from being strongly pressed against the separation protrusion 79 located on the most downstream side at the front surface of the sheet P. As a result, damage on the front surfaced of its sheet P, like a glossy paper, can be prevented, and thereby deterioration of image quality to be recorded can be prevented.

As shown in FIGS. 13A and 13B, the separation member 11 may be disposed so that each window hole 72 has a space for a clearance dimension W1 between a downstream-side end surface defining each window hole 72 and its corresponding arm portion 77. Thus, the arm portion 77 and the separation protrusion 79 disposed in each window hole 72 are allowed to bend toward the downstream side with respect to the sheet feeding direction (arrow A). With this structure, when the sheet P is separated from the stack and fed, the separation protrusions 79 are allowed to bend toward the downstream side and thus the separation function can be maintained. Moreover, the separation member 11 may be disposed so that, in each window hole 72, the arm portion 77 contacts an upstream-side end surface defining its window hole 72. This structure can prevent deformation of the arm portions 77 which may occur as a result of bending toward the upstream side with respect to the sheet feeding direction, maintain the separation function, and reinforce the arm portions 77 and the separation protrusions 79. Similarly, this structure can prevent unnecessary deformation of the arm portions 77, which may occur when an end portion of a stack of a number of sheets P stored in the cassette body 3 contacts the separation protrusions 79.

As the inclined separation plate 8 may be formed separately from the cassette body 3, the separation member 11 can be easily mounted to the inclined separation plate 8 from the rear, and thus assembly operation can be also facilitated.

Although the above structure provides strength through the inclined separation plate 8 only, the strength of the inclined separation plate 8 may be generated through provision of additional parts. The following description is made with reference to FIGS. 14 through 17. It is noted that throughout FIGS. 14 through 17 elements similar to or identical with those shown in the above structure are designated by same or similar numerals, and thus the description thereof can be omitted for the sake of brevity.

Figure 14:
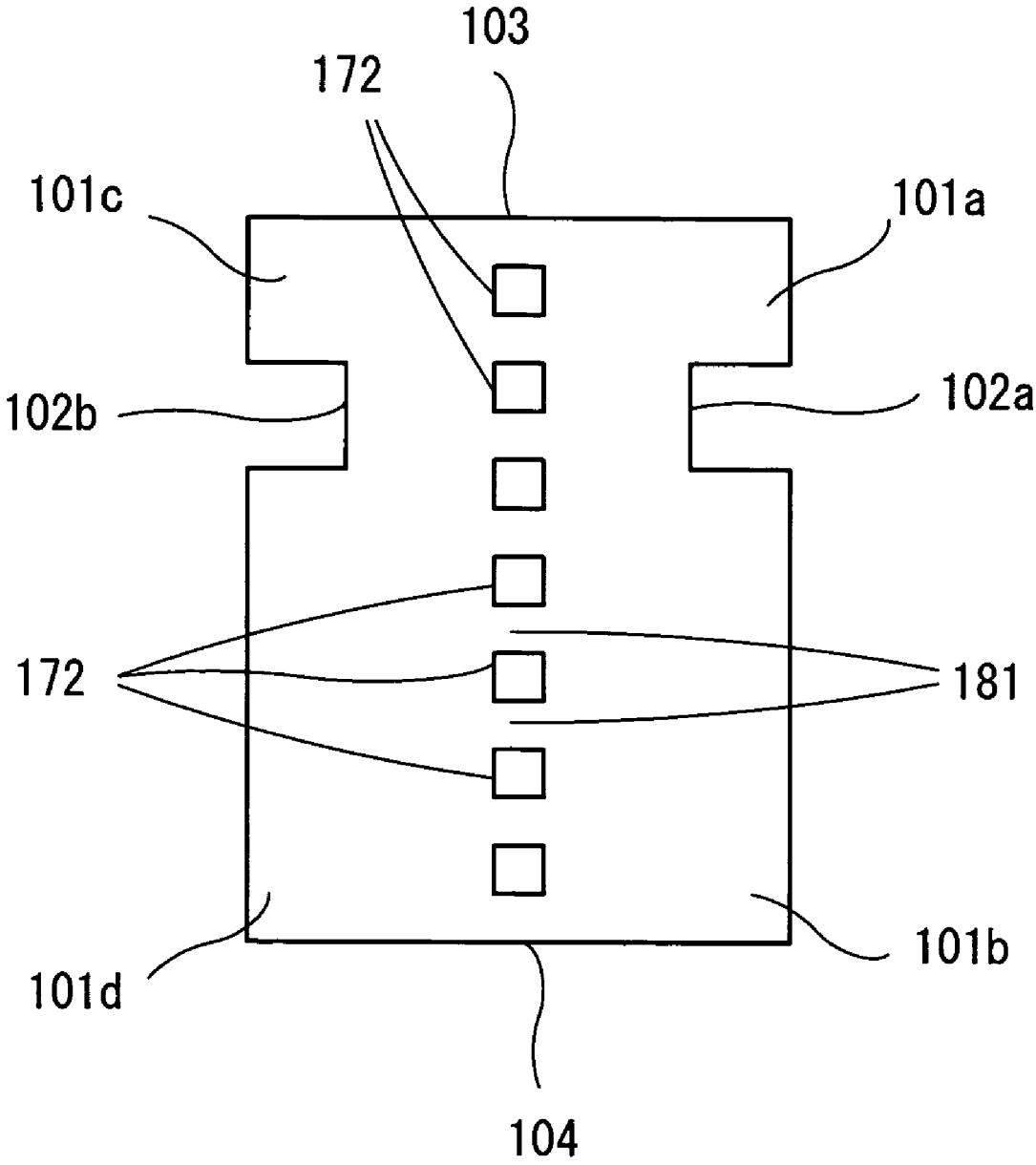
FIG. 14 a plan view of a reinforcing plate.
Figure 15:
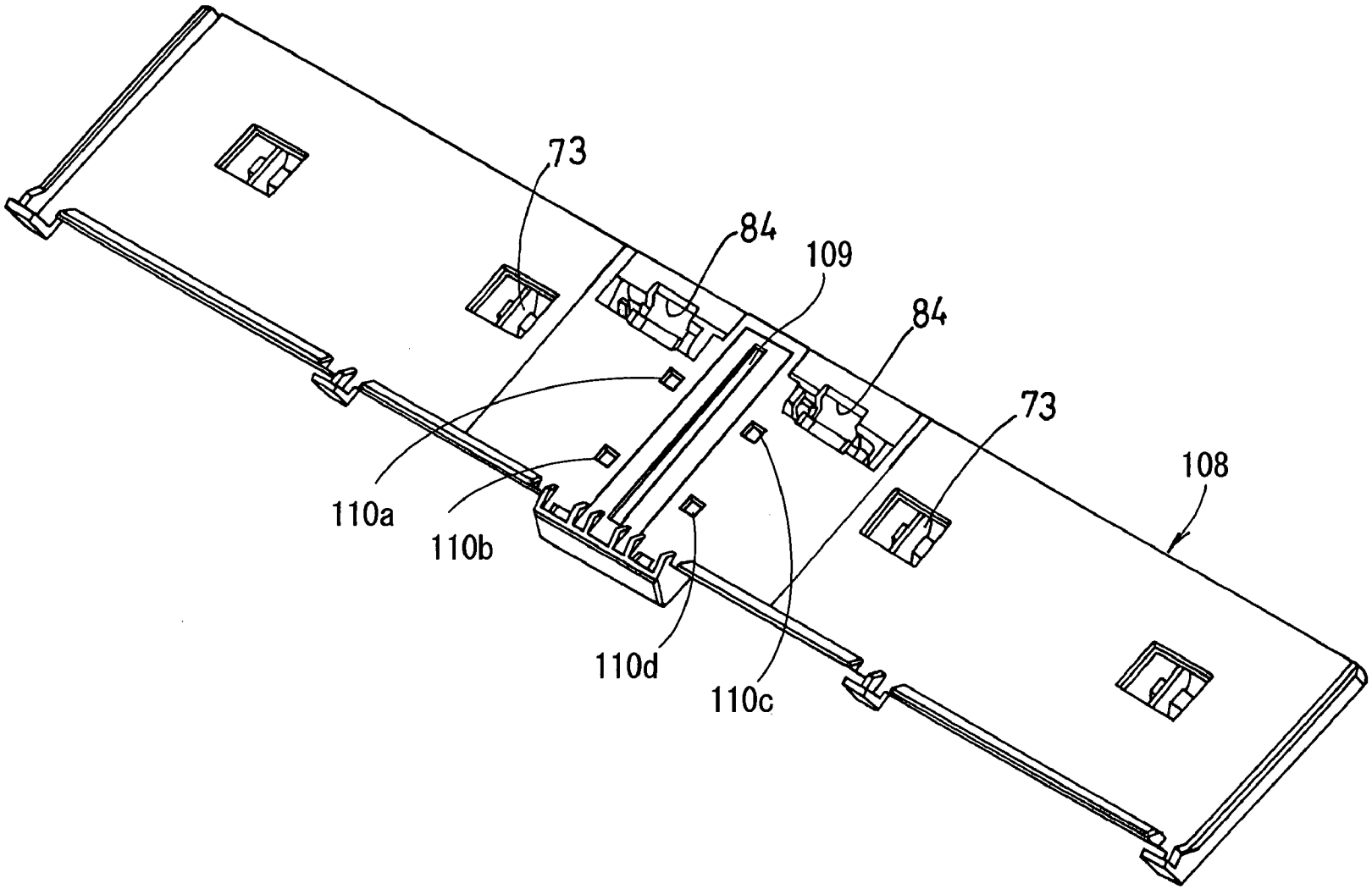
FIG. 15 a perspective view of an inclined separation plate viewed from its front side to which the reinforcing plate is to be attached.
Figure 16:
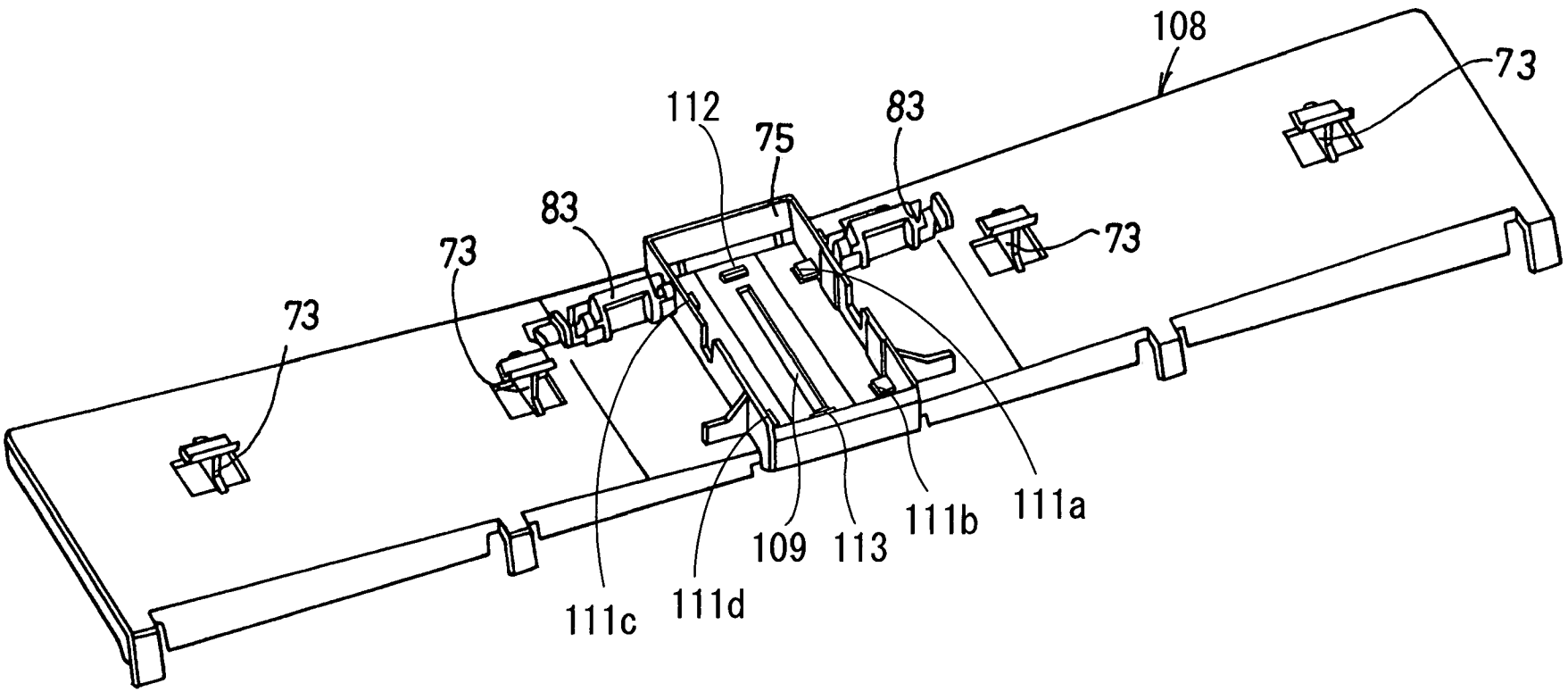
FIG. 16 is a perspective view of the inclined separation plate viewed from its back side to which the reinforcing plate is to be attached.

FIG. 14 is a plan view of a reinforcing plate 100 for reinforcing the strength of the inclined separation plate 8. The reinforcing plate 100 is provided with a plurality of holes 172 through which the protrusions 79 protrude. In addition, the reinforcing plate 100 is provided with protruding portions 101*a*, 101*b*, 101*c*, 101*d*, and recessed portions 102*a*, 102*b*, which are all used to secure the reinforcing plate 100 to an inclined separation plate 108 (FIGS. 15 and 16). The reinforcing plate 100 may be preferably made of metal to provide strength. Alternately, it may be made of reinforced plastics or other materials (including but not limited to ceramics and the like).

The inclined separation plate 108 is provided with a slot 109 that allows all separation protrusions 79 to protrude out. As shown in FIG. 16, protruding portions 111*a*, 111*b*, 111*c*, 111*d* for holding and fixing the reinforcing plate 100 and protrusions 112, 113 for placing the reinforcing plate 100 in position are provided in the mounting case 75 of the inclined separation plate 108. The inclined separation plate 108 has holes 110*a*, 110*b*, 110*c*, 110*d* (FIG. 15) that may be used to mold the protruding portions 111*a*, 111*b*, 111*c*, 111*d*.

A method to attach the reinforcing plate 100 to the inclined separation will be described. First, the reinforcing plate 100 is placed in the mounting case 75 of the inclined separation plate 108. At this time, to keep the reinforcing plate 100 out of contact with the protruding portions 111*a*, 111*b*, 111*c*, 111*d* of the inclined separation plate 108, the recessed portions 102*a*, 102*b* of the reinforcing plate 100 should be aligned with the protruding portions 111*a*, 111*c* of the inclined separation plate 108. Then, the reinforcing plate 100 is slid with its surface contact with the inclined separation plate 108 so that the protruding portion 101*a* of the reinforcing plate 100 is interposed between the protruding portion 111*a* and the hole 110*a* of the inclined separation plate 108. Similarly, the protruding portion 101*b* of the reinforcing plate 100 is interposed between the protruding portion 111*b* and the hole 110*b* of the inclined separation plate 108, the protruding portion 101*c* of the reinforcing plate 100 is interposed between the protruding portion 111*c* and the hole 110*c* of the inclined separation plate 108, and the protruding portion 110*d* of the reinforcing plate 100 is interposed between the protruding portion 111*d* and the hole 110*d* of the inclined separation plate 108. End portions 103, 104 of the reinforcing plate 100 are placed in position in contact with the positioning protrusions 112, 113, respectively. Preferably, the reinforcing plate 100 and the inclined separation plate 108 are bonded to each other with this condition.

When the reinforcing plate 100 is attached to the inclined separation plate 108 as described above, the holes 172 of the reinforcing plate 100 and the slot 109 of the inclined separation plate 108 are combined to form a plurality of window holes. Accordingly, the strength of the inclined separation plate 108 can be increased. The reinforcing plate 100 may be attached to the inclined separation plate 108 in a different manner from the above method. The reinforcing plate 100 may be bonded to the inclined separation plate 100, and the reinforcing plate 100 and the inclined separation plate 108 may be insert-molded together. The inclined separation plate 108 may include one or more holes. As described above, the reinforcing plate 100 is provided on a backside surface of the inclined separation plate 108. Thus; damage on the recording sheet can be avoided when the recording sheet is fed.

Figure 17:
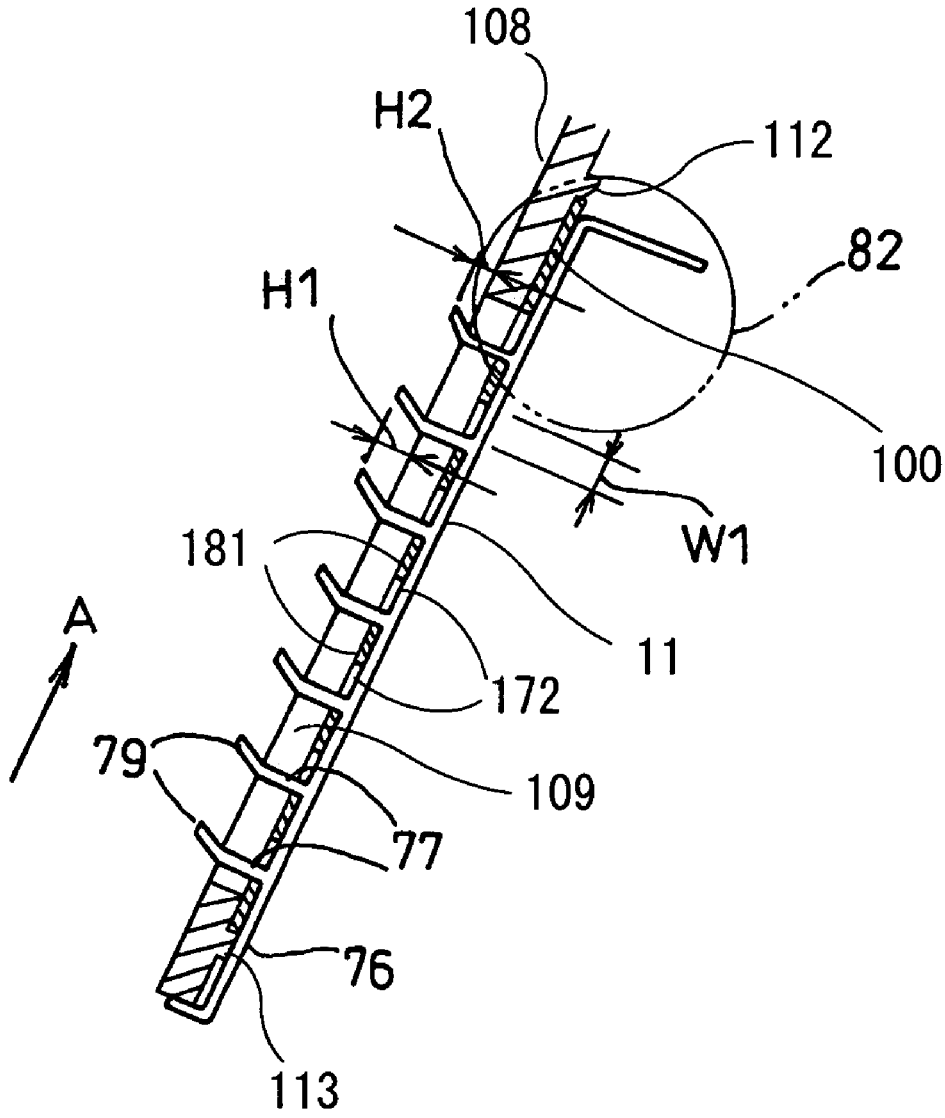
FIG. 17 is a sectional view showing separation protrusions when the reinforcing plate is attached to the inclined separation plate.

FIG. 17 shows that the separation protrusions 79 protrude from the inclined separation plate 108 when the separation member 11 is attached. The separation protrusions 79 protrude toward the front of the inclined separation plate 108 via space defining the slot 109 of the inclined separation plate 108 and each hole 172 of the reinforcing plate 100 by a specified amount. Each hole 172 has a space between a downstream-side end surface defining each hole 172 and its corresponding arm portion 77. When the sheet P is separated from the stack and fed, the separation protrusions 79 are allowed to bend toward the downstream side and thus the separation function can be maintained. Moreover, in each hole 172 of the reinforcing plate 100, the arm portion 77 contacts an upstream-side end surface defining its hole 172 with respect to the sheet feeding direction (arrow A). Thus, this structure can prevent or reduce unnecessary deformation of the arm portions 77 toward the upstream side. In this structure, one separation protrusion 79 protrudes through each hole 172. It can be applied that more than two separation protrusions 79 protrude through each hole 172.

The disclosure may apply to an image recording apparatus equipped with vertically arranged multiple cassette bodies.

While the various aspects of the disclosure have been described in conjunction with the illustrative embodiments outlined above, various alternatives, modifications, variations, improvements and/or substantial equivalents, whether known or that are or may be presently unforeseen, may become apparent to those having at least ordinary skill in the art. Accordingly, the illustrative embodiments of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

What is claimed is:

1. A sheet feeder comprising:

a holder capable of storing a plurality of recording sheets in a stack;

a sheet feed roller capable of feeding an uppermost recording sheet in the stack;

an inclined separation plate that is provided on a downstream side of the holder with respect to a sheet feeding direction, the inclined separation plate extending in a direction perpendicular to the sheet feeding direction, the inclined separation plate having a plurality of window holes arranged along the sheet feeding direction; and a separation member that is attached to the inclined separation plate, the separation member capable of separating the recording sheets one-by-one from the stack in cooperation with the sheet feed roller, the separation member having a plurality of separation protrusions arranged along the sheet feeing direction, wherein the separation protrusions protrude from the window holes in a direction where the inclined separation plate faces the recording sheets stored in the holder.

2. The sheet feeder according to claim 1, wherein the inclined separation plate is curved in the direction perpendicular to the sheet feeding direction so as to go back toward both end portions thereof.

3. The sheet feeder according to claim 1, wherein the inclined separation plate has a uniform thickness in a portion provided between adjacent window holes and a neighboring portion thereof.

4. The sheet feeder according to claim 1, wherein the plurality of window holes are arranged in a center of the inclined separation plate with respect to the direction perpendicular to the sheet feeding direction.

5. The sheet feeder according to claim 1, wherein each of the plurality of separation protrusions is capable of protruding from a corresponding one of the plurality of window holes.

6. The sheet feeder according to claim 5, wherein the separation member includes a plurality of arm portions each supporting a corresponding one of the plurality of separation protrusions, and each arm portion contacts an upstream-side end surface defining a corresponding one of window holes.

7. The sheet feeder according to claim 5, wherein the separation member includes a plurality of arm portions each supporting a corresponding one of the plurality of separation protrusions, and each arm portion is located at a specified distance away from a downstream-side end surface defining a corresponding one of the window holes.

8. The sheet feeder according to claim 1, wherein a height of a separation protrusion located on a most downstream side with respect to the sheet feeding direction protruding from a corresponding window hole is less than a height of a separation protrusion located on an upstream side with respect to the sheet feeding direction protruding from a corresponding window hole.

9. The sheet feeder according to claim 8, further comprising rollers provided on approximately a same downstream side as the separation protrusion located on the most downstream side, and on each side across the separation protrusion, wherein the rollers protrude from the inclined separation plate, wherein a height of the rollers protruding from the inclined separation plate is substantially equal to or slightly less than a height of the separation protrusion located on the most downstream side with respect to the sheet feeding direction protruding from the corresponding window hole.

10. The sheet feeder according to claim 1, wherein the holder has an inclined separation plate supporting portion capable of supporting the inclined separation plate detachably.

11. The sheet feeder according to claim 1, wherein the inclined separation plate has an accommodating portion capable of accommodating the separation member therein, and the sheet feeder further comprises a supporting member capable of supporting the separation member in contact with the inclined separation plate in the accommodating portion.

12. The sheet feeder according to claim 1, wherein said holder is a cassette body.

13. The sheet feeder according to claim 1, wherein said holder is a fixed tray.

14. A method of forming a sheet feeder where the sheet feeder includes a holder capable of storing a plurality of recording sheets in a stack, a sheet feed roller capable of feeding an uppermost recording sheet in the stack, an inclined separation plate that is provided on a downstream side of the holder with respect to a sheet feeding direction, the inclined separation plate extending in a direction perpendicular to the sheet feeding direction; and a separation member that is attached to the inclined separation plate, the separation member capable of separating the recording sheets one-by-one from the stack in cooperation with the sheet feed roller, said method comprising the steps of:

forming a plurality of windows in the separation plate along the sheet feeding direction;

forming a plurality of protrusions in the separation member; and combining the separation plate and the separation member so that the plurality of protrusions protrudes via the plurality of window holes.

15. A sheet feeder comprising:

a holder capable of storing a plurality of recording sheets in a stack;

a sheet feed roller capable of feeding an uppermost recording sheet in the stack;

an inclined separation plate that is provided on a downstream side of the holder with respect to a sheet feeding direction, the inclined separation plate extending in a direction perpendicular to the sheet feeding direction, the inclined separation plate has a window hole extending along the sheet feeding direction;

a window component that is fixed to the inclined separation plate; and a separation member that is attached to the inclined separation plate, the separation member capable of separating the recording sheets one-by-one from the stack in cooperation with the sheet feed roller, the separation member has a plurality of separation protrusions arranged along the sheet feeing direction, wherein a plurality of window holes is formed by combining the inclined separation plate and the window component, the separation protrusions protrude from the window holes where the inclined separation plate faces the recording sheets stored in the holder.

16. The sheet feeder according to claim 15, wherein the window component is provided on a backside surface of the inclined separation plate.

17. The sheet feeder according to claim 15, wherein the window component is a metal plate.

18. The sheet feeder according to claim 15, wherein each of the plurality of separation protrusions is capable of protruding from a corresponding one of the plurality of window holes.

19. The sheet feeder according to claim 18, wherein the separation member includes a plurality of arm portions each supporting the plurality of separation protrusions, and each arm portion is in contact with an upstream-side end surface defining a corresponding one of the window holes.

20. The sheet feeder according to claim 18, wherein the separation member includes a plurality of arm portions each supporting the plurality of separation protrusions, and each arm portion is located at a specified distance away from a downstream-side end surface defining a corresponding one of the window holes.

21. The sheet feeder according to claim 15, wherein the window component is provided coplanar with a surface of the inclined separation plate.

22. A method of forming a sheet feeder where the sheet feeder includes a holder capable of storing a plurality of recording sheets in a stack, a sheet feed roller capable of feeding an uppermost recording sheet in the stack, an inclined separation plate that is provided on a downstream side of the holder with respect to a sheet feeding direction, the inclined separation plate extending in a direction perpendicular to the sheet feeding direction, and a separation member that is attached to the inclined separation plate, the separation member capable of separating the recording sheets one-by-one from the stack in cooperation with the sheet feed roller, said method comprising the steps of:

forming at least one window in the inclined separation plate;

forming a plurality of window holes along the sheet feed direction by adding a window component to the inclined separation plate;

forming a plurality of protrusions in the separation member; and combining the separation plate and the separation member so that the plurality of protrusions protrudes via the plurality of window holes.

23. The method according to claim 22, wherein said combining step combines the separation plate and the separation member such that at least one protrusion protrudes through one window hole.

24. The method according to claim 22, wherein said combining step combines the separation plate and the separation member such that at least two protrusions protrude through one window hole.

* * * * *